US008899348B2

(12) United States Patent
Henderson et al.

(10) Patent No.: US 8,899,348 B2
(45) Date of Patent: Dec. 2, 2014

(54) SURFACE GAS EVALUATION DURING CONTROLLED PRESSURE DRILLING

(75) Inventors: Anthony Bruce Henderson, Kingwood, TX (US); Douglas Law, Plymouth (GB); Michael Brian Grayson, Sugar Land, TX (US); James R. Chopty, Aberdeen (GB); David Tonner, The Woodland, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 997 days.

(21) Appl. No.: 12/905,017

(22) Filed: Oct. 14, 2010

(65) Prior Publication Data

US 2011/0139464 A1 Jun. 16, 2011

Related U.S. Application Data

(60) Provisional application No. 61/252,361, filed on Oct. 16, 2009.

(51) Int. Cl.
*E21B 49/00* (2006.01)
*E21B 7/00* (2006.01)

(52) U.S. Cl.
USPC ..... 175/48; 175/50; 175/208; 166/250.01; 166/250.08; 166/91.1

(58) Field of Classification Search
USPC ..... 166/250.07, 91.1, 250.01, 250.08; 175/48, 50, 59, 207, 218; 702/9; 73/152.19, 152.21, 152.23
See application file for complete search history.

(56) References Cited

U.S. PATENT DOCUMENTS

| | | | | |
|---|---|---|---|---|
| 4,635,735 | A | 1/1987 | Crownover | |
| 5,469,917 | A | 11/1995 | Wolcott | |
| 6,092,416 | A * | 7/2000 | Halford et al. | 73/152.23 |
| 6,276,190 | B1 | 8/2001 | Zamfes | |
| 6,974,705 | B1 | 12/2005 | Brumboiu et al. | |
| 7,044,237 | B2 | 5/2006 | Leuchtenberg | |
| 7,111,503 | B2 | 9/2006 | Brumboiu et al. | |
| 7,210,342 | B1 | 5/2007 | Sterner et al. | |
| 7,278,496 | B2 | 10/2007 | Leuchtenberg | |
| 7,318,343 | B2 | 1/2008 | Coenen | |
| 7,350,597 | B2 | 4/2008 | Reitsma et al. | |
| 7,367,411 | B2 | 5/2008 | Leuchtenberg | |
| 7,438,128 | B2 | 10/2008 | Drozd et al. | |
| 7,610,251 | B2 | 10/2009 | Shayegi et al. | |
| 7,650,950 | B2 | 1/2010 | Leuchtenberg | |
| 7,806,202 | B2 | 10/2010 | Stewart | |
| 2005/0252286 | A1 | 11/2005 | Ibrahim et al. | |
| 2009/0194330 | A1 | 8/2009 | Gray | |

OTHER PUBLICATIONS

Patent Examination Report No. 1 in counterpart Australian Appl. 2010305694, dated Sep. 21, 2012.

(Continued)

*Primary Examiner* — Robert E Fuller
(74) *Attorney, Agent, or Firm* — Wong, Cabello, Lutsch, Rutherford & Brucculeri, LLP

(57) ABSTRACT

A system and method have a choke in fluid communication with a rotating control device. The choke controls flow of drilling mud from the rotating control device to a gas separator during a controlled pressure drilling operation, such as managed pressure drilling (MPD) or underbalanced drilling (UBD). A probe is in fluid communication with the drilling mud between the choke and the gas separator. During operations, the probe evaluates gas in the drilling mud from the well passing from the choke to the gas separator.

39 Claims, 27 Drawing Sheets

(56) References Cited

OTHER PUBLICATIONS

First Office Action in counterpart Canadian Appl. 2,742,387, dated Mar. 19, 2013.
Weatherford, "GC-Tracer Surface Gas Detector," Brochure, copyright 2009.
Dria, Dennis E. et al., "Membrane-Based Gas Sensing for Robust Pay Identification," Presented at the 42nd Annual SPWLA Logging Symposium, Houston, Texas Jun. 17-20, 2001.
Weatherford, "GC-Tracer Surface Gas Detector—Gas Chromatograph Tool . . . ," Brochure, copyright 2009.
Secure Drilling, "Secure Drilling System using Micro-Flux Control Technology", Brochure, copyright 2007.
Weatherford, "Managed Pressure Drilling," Brochure, copyright 2007-2008.
Weatherford, "Application Answers: Constant Bottomhole Pressure," Brochure, copyright 2005-2006.
Weatherford, "Application Answers: Dual Gradient Drilling," Brochure, copyright 2005-2006.
Weatherford, "Application Answers: Pressurized Mud-Cap Drilling," Brochure, copyright 2005-2006.
Weatherford, "Application Answers: Returns-Flow-Control Drilling," Brochure, copyright 2005-2006.
International Search Report and Written Opinion for PCT/US2010/052806, dated Dec. 13, 2010.

* cited by examiner

SURFACE GAS EVALUATION DURING CONTROLLED PRESSURE DRILLING

CROSS-REFERENCE TO RELATED APPLICATIONS

This is a non-provisional of U.S. Provisional Appl. Ser. No. 61/252,361, filed 16 Oct. 2009, to which priority is claimed and which is incorporated herein by reference in its entirety.

BACKGROUND

Several controlled pressure drilling techniques are used to drill wellbores. In general, controlled pressure drilling includes managed pressure drilling (MPD), underbalanced drilling (UBD), and air drilling (AD) operations. In the Underbalanced Drilling (UBD) technique, a UBD system allows the well to flow during the drilling operation. To do this, the UBD system maintains a lighter mud-weight of drilling mud so that fluids from the formation being drilled are allowed to enter the well during the operation. To lighten the mud, the UBD system can use a lower density mud in formations having high pressures. Alternatively, the UBD system can inject an inert gas such as nitrogen into the drilling mud. During the UBD operation, a rotating control device (RCD) at the surface allows the drill string to continue rotating and acts as a seal so produced fluids can be diverted to a mud gas separator. Over all, the UBD system allows operators to drill faster while reducing the chances of damaging the formation.

In the Managed Pressure Drilling (MPD) technique, a MPD system uses a closed and pressurizable mud-return system, a rotating control device (RCD), and a choke manifold to control the wellbore pressure during drilling. The various MPD techniques used in the industry allow operators to drill successfully in conditions where conventional technology simply will not work by allowing operators to manage the pressure in a controlled fashion during drilling.

During drilling, the bit drills through a formation, and pores become exposed and opened. As a result, formation fluids (i.e., gas) can mix with the drilling mud. The drilling system then pumps this gas, drilling mud, and the formation cuttings back to the surface. As the gas rises up the borehole, the pressure drops, meaning more gas from the formation may be able to enter the wellbore. If the hydrostatic pressure is less than the formation pressure, then even more gas can enter the wellbore.

Gas traps, such as an agitation gas trap, are devices used for monitoring hydrocarbons in drilling mud at the surface so operators can evaluate hydrocarbon zones downhole. To determine the gas content of drilling mud, for example, a typical gas trap mechanically agitates mud flowing in a tank. The agitation releases entrained gases from the mud, and the released gases are drawn-off for analysis. The spent mud is simply returned to the tank to be reused in the drilling system. Unfortunately, the way that the agitator gas trap extracts gas from the drilling mud limits the reliability of its results. In addition, the total level of hydrocarbons in the mud (especially methane C1) heavily influences readings by the gas trap.

In MPD or UBD systems, the surface circulating system circulates drilling mud from the wellhead to pits. This circulating system is principally enclosed and uses a mud gas separator to remove gas from the drilling mud. The MPD or UBD systems present a number of problems for traditional surface gas detection. Unfortunately, traditional gas traps are not designed to work in enclosed pipe and do not operate under greater than ambient pressures. Therefore, any gas detection using the typical gas trap in the MPD and UBD systems must take place in the trough or at the end of the mud gas separator. In both cases, however, the gas trap produces erroneous gas signatures.

The subject matter of the present disclosure is directed to overcoming, or at least reducing the effects of, one or more of the problems set forth above.

SUMMARY

A controlled pressure drilling system disclosed herein can include a managed pressure drilling system, an underbalanced drilling system, or the like. The system has a choke in fluid communication with a wellbore. The choke can be part of a choke manifold for controlling flow of drilling fluid from the wellbore. The choke manifold is disposed downstream from a rotating control device or other type of device that keeps the wellbore closed during drilling. Adjustments of one or more chokes on the manifold controls surface backpressure in the wellbore for controlled pressure drilling operations.

Downstream from the choke, the system has a gas evaluation device in fluid communication with the flow of drilling fluid from the wellbore. The gas evaluation device disposes upstream of a gas separator for the system. As fluid flows from the wellbore, the gas evaluation device evaluates gas content in the drilling fluid.

A controller is operatively coupled to the choke and the gas evaluation device. To control drilling, the controller monitors one or more parameters indicative of a fluid loss or a fluid influx in the wellbore. Based on these monitored parameters, the controller adjusts the choke to control the surface backpressure in the wellbore.

When the controller determines that a fluid influx has occurred in the wellbore, the controller determines passage of the drilling fluid associated with the fluid influx from the wellbore past the gas evaluation device. Then, the controller determines the gas content associated with the fluid influx.

The controller can further correlate the determined gas content to density of the drilling fluid to determine a volume of the gas content associated with the fluid influx. For example, the controller can couple to a flow meter in fluid communication with the flow of drilling fluid from the wellbore. Based at least in part from flow measurements, the controller can determine the density of the drilling fluid for determining the volume. In turn, the controller can correlate the determined volume for the gas content to a bottomhole pressure in a portion of the wellbore where the fluid influx occurred so that the portion of the wellbore can be characterized.

The controller can make a number of corrections to determine the gas content and its volume associated with the fluid influx. These corrections can be based on pressure, temperature, flow, and other measurements made by the system. In addition, the controller can evaluate initial gas content of flow of drilling fluid into the wellbore and can subtract the initial gas content from the gas content evaluated from the flow of drilling fluid out of the wellbore. This measurement can be made with an ancillary probe disposing in the flow of the drilling fluid into the wellbore.

In one arrangement, the gas evaluation device includes a probe that disposes in fluid communication between the wellbore and the gas separator. This probe can be disposed on a first flow line having valves disposed on either end so the probe can be isolated from the flow of drilling fluid as needed. A second flow line can bypass the first flow line and can have its own valve.

In one arrangement, the probe disposes in the flow of drilling fluid from the wellbore and extracts a gas sample therefrom. A gas chromatograph obtains the extracted gas sample entrained in the carrier fluid from the probe and evaluates the gas content of the extracted gas sample.

To extract a gas sample, the probe can have a permeable membrane separating a carrier fluid from the drilling fluid. Based on a pressure differential across the membrane, the membrane can permit passage of the gas sample from the drilling fluid therethrough so that the gas samples become entrained in the carrier fluid. To deal with possible condensation of gas, a purge circuit in fluid communication with the probe can pneumatically purge the probe of fluid on a regular basis.

Alternative to the permeable membrane probe, the gas evaluation device can receive a sample of the drilling fluid routed or purged thereto. Then, a gas chromatograph, an optical sensor, a mass spectrometer, or a mud logging sensor can analyze the sample of the drilling fluid received.

The foregoing summary is not intended to summarize each potential embodiment or every aspect of the present disclosure.

DETAILED DESCRIPTION

A. System Overview

Figure 1A:
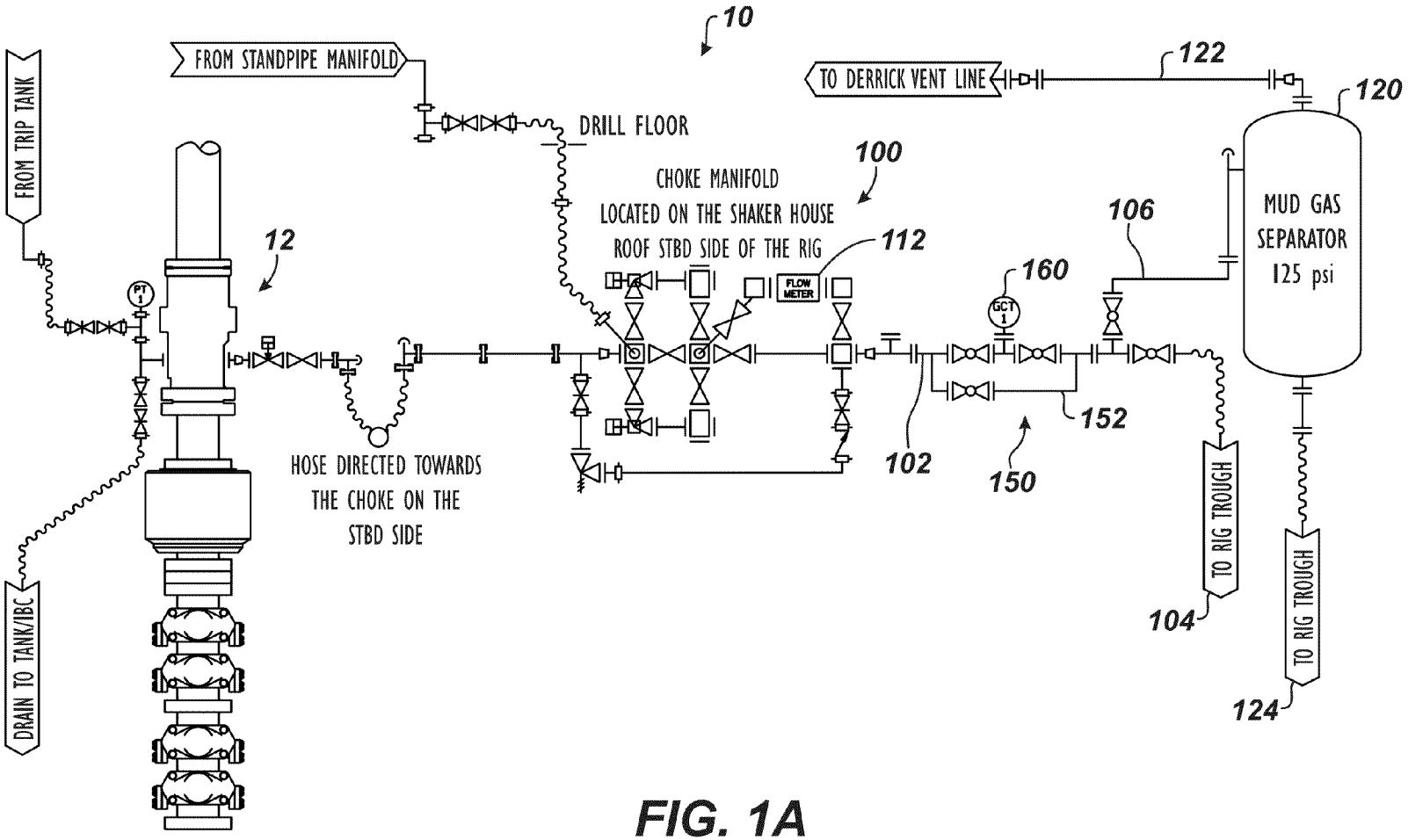
FIG. 1A schematically illustrates a controlled pressure drilling system according to the present disclosure.
Figure 1B:
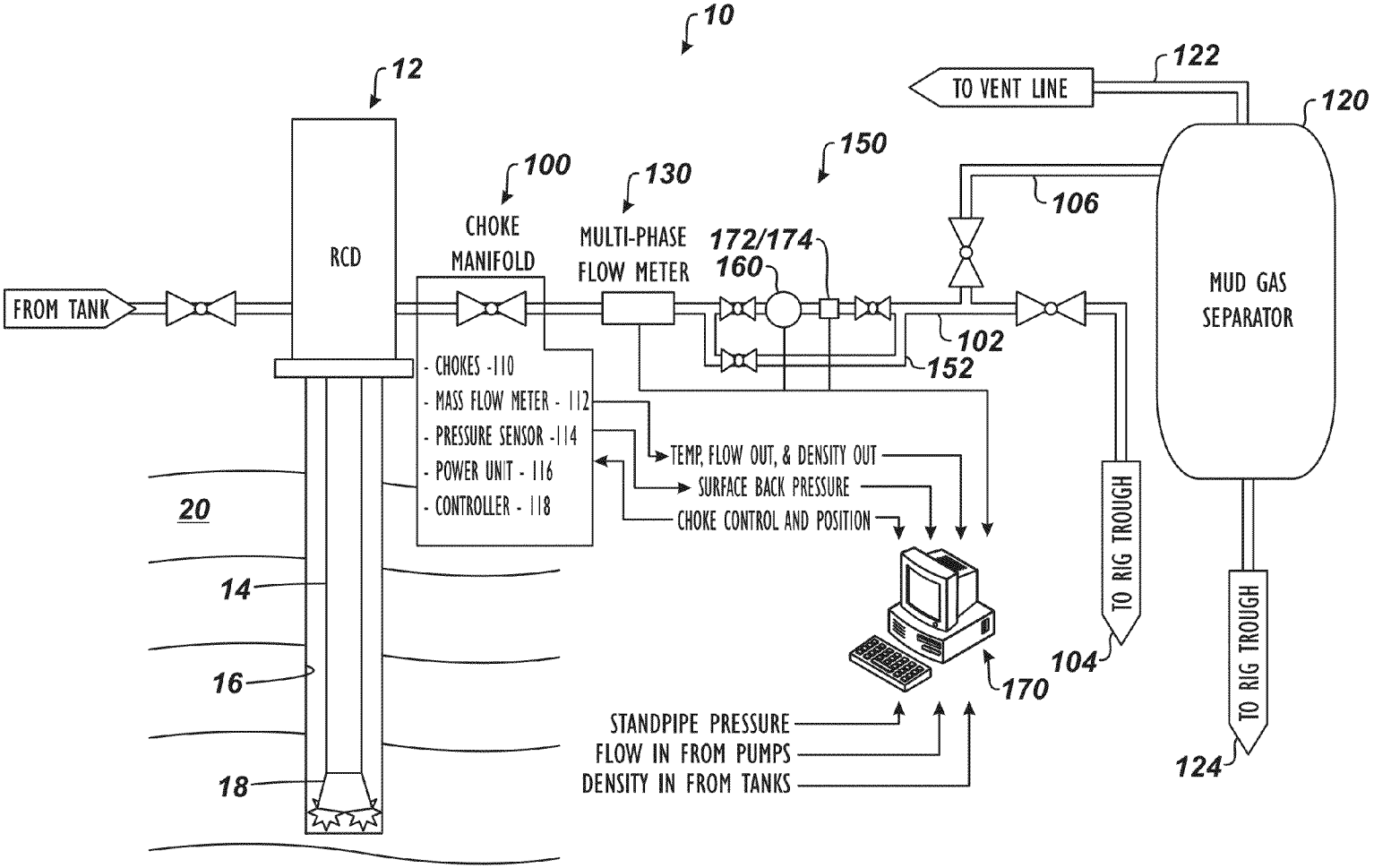
FIG. 1B diagrammatically illustrates the system of FIG. 1A.

FIG. 1A schematically shows a controlled pressure drilling system 10 according to the present disclosure, and FIG. 1B shows a diagrammatic view of the system 10. As shown and discussed herein, this system 10 is a Managed Pressure Drilling (MPD) system and, more particularly, a Constant Bottomhole Pressure (CBHP) form of MPD system. Although discussed in this context, the teachings of the present disclosure can apply equally to other types of controlled pressure drilling systems, such as other MPD systems (Pressurized Mud-Cap Drilling, Returns-Flow-Control Drilling, Dual Gradient Drilling, etc.) as well as to Underbalanced Drilling (UBD) systems, as will be appreciated by one skilled in the art having the benefit of the present disclosure.

The MPD system 10 has a rotating control device (RCD) 12 from which a drill string 14 and drill bit 18 extend downhole in a wellbore 14 through a formation 20. The rotating control device 12 can include any suitable pressure containment device that keeps the wellbore closed at all times while the wellbore is being drilled. The system 10 also includes mud pumps (not shown), a standpipe (not shown), a mud tank (not shown), a mud gas separator 120, and various flow lines (102, 104, 106, 122, 124), as well as other conventional components. In addition to these, the MPD system 10 includes an automated choke manifold 100 that is incorporated into the other components of the system 10.

As best shown in FIG. 1B, the automated choke manifold 100 manages pressure during drilling and is incorporated into the system 10 downstream from the rotating control device 12 and upstream from the gas separator 120. The manifold 100 has chokes 110, a mass flow meter 112, pressure sensors 114, a hydraulic power unit 116 to actuate the chokes 110, and a controller 118 to control operation of the manifold 100. A data acquisition system 170 communicatively coupled to the manifold 100 has a control panel with a user interface and processing capabilities. The mass flow meter 112 can be a Coriolis type of flow meter.

One suitable drilling system 10 with choke manifold 100 for the present disclosure is the Secure Drilling™ System available from Weatherford. Details related to such a system are disclosed in U.S. Pat. No. 7,044,237, which is incorporated herein by reference in its entirety.

As shown in FIG. 1B, the system 10 uses the rotating control device 12 to keep the well closed to atmospheric conditions. Fluid leaving the well flows through the automated choke manifold 100, which measures return flow and density using the coriolis flow meter 112 installed in line with the chokes 110. Software components of the manifold 100 then compare the flow rate in and out of the wellbore 16, the injection pressure (or standpipe pressure), the surface backpressure (measured upstream from the drilling chokes 110), the position of the chokes 110, and the mud density. Comparing these variables, the system 10 identifies minute downhole influxes and losses on a real-time basis and to manage the annulus pressure during drilling. All of the monitored information can be displayed for the operator on the control panel of the data acquisition system 170.

During drilling operations, the system 170 monitors for any deviations in values and alerts the operators of any problems that might be caused by a fluid influx into the wellbore 16 from the formation 20 or a loss of drilling mud into the formation 20. In addition, the system 170 can automatically detect, control, and circulate out such influxes by operating the chokes 110 on the choke manifold.

For example, a possible fluid influx can be noted when the "flow out" value (measured from flow meter 112) deviates from the "flow in" value (measured from the mud pumps). When an influx is detected, an alert notifies the operator to apply the brake until it is confirmed safe to drill. Meanwhile, no change in the mud pump rate is needed at this stage.

In a form of auto kick control, however, the system 170 automatically closes the choke 110 to a determined degree to increase surface backpressure in the wellbore annulus 16 and stop the influx. Next, the system 170 circulates the influx out of the well by automatically adjusting the surface backpressure, thereby increasing the downhole circulating pressure and avoiding a secondary influx. A conceptualized trip tank is monitored for surface fluid volume changes because conventional pit gain measurements are usually not very precise. This is all monitored and displayed to offer additional control of these steps.

On the other hand, a possible fluid loss can be noted when the "flow in" value (measured from the pumps) is greater than the "flow out" value (measured by the flow meter 112). Similar steps as those above but suited for fluid loss can then be implemented by the system 170 to manage the pressure during drilling in this situation.

In addition to the manifold 100, the system 10 includes a gas evaluation device 150 incorporated into the components of the system 10. As shown, the device 150 disposes downstream from the choke manifold 100 and upstream from the gas separator 120. Because the device 150 is located between the manifold 100 and separator 120 and prior to the cuttings trough diverter, the device 150 can perform fluid monitoring whether the separator 120 is used or not.

As disclosed herein, reference is made to the disclosed device 150 as being a "gas evaluation device." However, it will be apparent with the benefit of the present disclosure that the disclosed evaluation device 150 can be used for evaluating any number of fluids and not just gas in drilling fluid or mud. Therefore, in the context of the present disclosure, reference to evaluating gas in drilling fluid likewise refers to evaluating any subject fluid in drilling fluid for evaluation. In general, the evaluation device 150 can evaluate hydrocarbons (e.g., C1 to C10 or higher), non-hydrocarbon gases, carbon dioxide, nitrogen, aromatic hydrocarbons (e.g., benzene, toluene, ethyl benzene and xylene), or other gases or fluids of interest in drilling fluid.

As noted previously, conventional gas traps used in the art to determine gas content in the drilling mud are suited for ambient pressures and are placed in the trough or downstream of the separator 120. These limitations lead to erroneous gas signatures. The gas evaluation device 150 of the present disclosure, however, is disposed in the flow line 102 leading from the choke manifold 100 to the gas separator 120.

As provided in more detail below, the device 150 is preferably a gas extraction device that uses a semi-permeable membrane to extract gas from the drilling mud for analysis. Because the gas in the drilling mud may be dissolved and/or free gas, the system 10 can calculate the dissolved and free-gas make-up. Preferably, the system 10 uses a multi-phase flow meter 130 in the flow line 102 to assist in determining the make-up of the gas. As will be appreciated, the multi-phase flow meter 130 can help model the gas flow in the drilling mud and provide quantitative results to refine the calculation of the gas concentration in the drilling mud.

As detailed below, the gas evaluation device 150 can extract hydrocarbons (e.g., C1 to C10) and other gases or fluids from the drilling mud, and a gas chromatograph (described below) analyzes the extracted gas or fluid to determine its make-up. Extracting the gas or fluid from the mud and passing it to the gas chromatograph may take a certain amount of processing time to determine the concentration of the particular gas content. Therefore, the device 150 can be tailored to monitor hydrocarbons in a particular range for a given application. In general, the device 150 can monitor hydrocarbons in the range of C1 to C5 for analysis in about 20-sec, the range of C1 to C8 in about 60-sec, and the range of C1 to C10 in about 135-sec.

The gas evaluation device 150 can discretely monitor each of the various types of gas C1 to C10 or some subset thereof in a sequential fashion to characterize the gas from the formation carried by the drilling mud. Alternatively, more than one gas evaluation device 150 can be used to monitor the gas in the passing drilling mud. In other words, one device 150 can monitor the gas content for each type—i.e., a first device for C1, a second device for C2, etc. Alternatively, any combination gas evaluation devices 150 can monitor one or more types of gas content. In this way, the devices 150 can essentially monitor each gas type continually as the drilling mud passes the devices 150. This can provide more comprehensive and complete detail of the gas content of the drilling mud passing from the choke manifold 100.

Incorporating the gas evaluation device 150 into the system 10 avoids the erroneous gas signatures obtained with conventional gas traps. Yet, the device 150 also provides high-resolution gas analysis, flow density, and pressure data during drilling that can then be used to determine characteristics of the underlying formation 20 currently being drilled. In turn, this information can be used for a number of purposes detailed herein.

B. Process Overview

Figure 2:
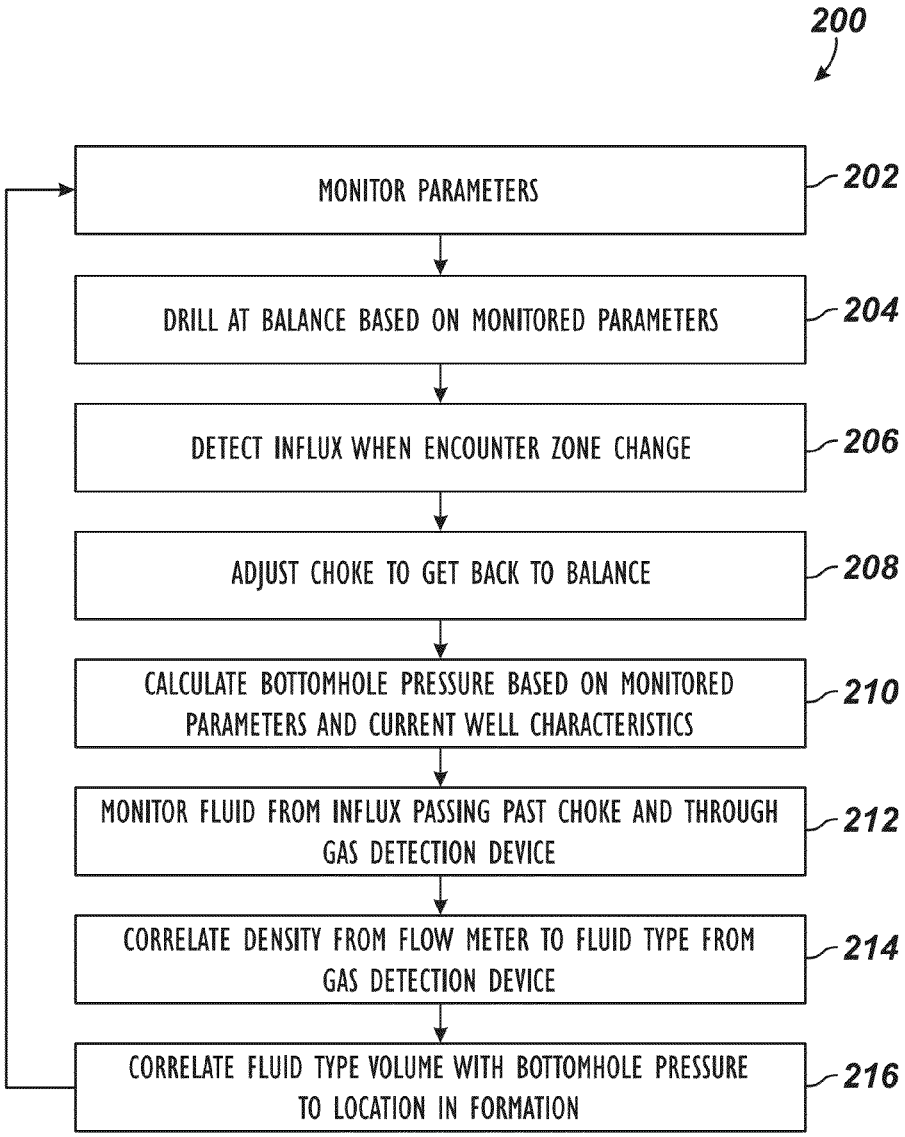
FIG. 2 illustrates a process for evaluating surface gas during managed pressure drilling according to the present disclosure.

With an understanding of the system 10 provided above, discussion now turns to a process 200 in FIG. 2 for evaluating surface gas during controlled pressure drilling according to the present disclosure. During the drilling operation, the data acquisition system 170 monitors the several parameters of interest (Block 202). These include the flow rate in and out of the wellbore 16, the injection pressure (or standpipe pressure), the surface backpressure (measured upstream from the drilling choke), the position of the chokes 110, and the mud density, among other parameters useful for MPD, UBD, or other controlled pressure drilling operation. Based on these monitored parameters, operators can identify minute downhole influxes and losses on a real-time basis and can manage pressure to drill the wellbore "at balance" (Block 204). Eventually, the system 10 detects an influx when a change in a formation zone is encountered (Block 206). As detailed herein, the change can involve any of a number of possibilities, including reaching a zone in the formation with a higher formation pressure, for example.

With the detected influx, the system 10 automatically adjusts the chokes 110 on the manifold 100 to achieve balance again for managed pressure drilling (Block 208). As discussed above, the choke manifold 100 is disposed downstream from the rotating control device 12 and controls the surface backpressure in the well 16 by adjusting the flow of drilling mud out of the well from the rotating control device 12 to the gas separator 120.

Typically, various micro-adjustments are calculated and made to the choke 110 throughout the drilling process as the various operating parameters continually change. From the adjustments, the system 10 can determine the bottomhole pressure at the current zone of the formation, taking into account the current drilling depth, the equivalent mud weight, the static head, and other variables necessary for the calculation (Block 210).

Concurrent with the operation of the manifold 100, the gas evaluation device 150 monitors the drilling mud passing from the manifold 100 through the flow line 102 (Block 212). Eventually, after some calculated lag time that depends on the flow rate and the current depth of the well, the actual fluid from the formation causing the influx will reach the gas evaluation device 150. This lag time can be directly determined based on the known flow rates, depth of the wellbore, location of the zone causing the influx, etc. Operating as disclosed herein, the gas evaluation device 150 then directly determines the hydrocarbon gas content of the drilling mud passing through or by the device 150.

The gas evaluation device 150 can be calibrated for the particular drilling mud used in the system 10, and any suitable type of drilling mud could be used in the system 10. To obtain a delta reading, an auxiliary gas evaluation device (not shown) can be installed on the system 10 in the flow of drilling mud into the well (from the tanks or the mud pumps) to determine the initial gas content of the drilling mud flowing into the well. This value can then be subtracted from the reading by the device 150 taken downstream from the drilling mud flowing from the rotating control device 12. From this, a determination can be made as to what portion of the gas content is due to the influx encountered in the well.

As noted previously, the device 150 is located in the flow line 102 downstream from the choke manifold 100 and prior to the separator 120. This location allows the device 150 to perform direct gas analysis in any mode of operation. As noted previously, a conventional gas trap type of system would be located in the ditch and behind the separator 120. This conventional location requires two gas trap systems to perform gas analysis and allow for diverting the flow over the shakers or through the separator. Yet, gas analysis downstream from the gas separator 120 is directly affected by separator's degassing effect. This is not the case with the current device 150 disposed on the flow line 102 upstream from the gas separator 120.

The determined content of gas (hydrocarbon value, percentage, mixture, soluble, free) in the drilling mud is then correlated to the density of the drilling mud based on measurements from the flow meter 112 to determine the volume of the particular gas from the influx (Block 214). As is well known, the volumetric flow rate of the drilling mud will be its mass flow rate divided by the mud's density. Here, the density of the mud is constantly changing due to changes in temperature, pressure, compositional make-up of the mud (i.e., gas concentration), and phase of the fluid content (i.e., free gas or dissolved gas content). All of these monitored parameters are taken into account in the calculations of the volume of gas in the influx.

The fluid density from the system 10 can be used to determine the volume of free phase gas in the flow line 102, and the ratio of free phase to soluble gas can be used to correct the gas readings and determine the gas content. The various calculations can be simplified by assuming that all of the gas is methane (C1). However, the multiphase flow meter 130 is preferably used instead so that some of the roundabout calculations can be avoided.

Finally, the determined volume for the influx gas is correlated to the bottomhole pressure at the location in the formation where the influx occurred to characterize the zone in the well during drilling (Block 216). Ultimately, as will be detailed later, correlating the gas readings from the gas evaluation device 150 to the drilling readings from the choke manifold 100 and other components of the system 10 can allow operators to characterize the formation during the drilling operations.

For example, the correlated information can identify lithological boundaries and reservoir contacts, locate oil/water contacts downhole, detect fluid variations in the formation, and make other determinations disclosed herein. Furthermore, operators can identify the productivity of a zone during drilling. Based on the known drilling parameters, operators can determine the formation pressure and the pressure of the wellbore column that caused the influx. Using the techniques disclosed herein, operators can also determine the density/volume of the influx and the type of gas from the influx detected in the drilling mud. From the pressure information, the volume of gas that came from the formation, and the type of gas of the influx from the formation, operators can infer the productivity of the currently drilled zone.

C. Membrane-Based Gas Extraction Probe

As noted above, the gas evaluation device 150 preferably uses a probe having a semi-permeable membrane to extract gases directly from the drilling mud without the need for agitation required by a conventional gas trap. A preferred, membrane-based probe is the GC-TRACER available from Weatherford. Details related to the membrane-based probe known as GC-TRACER are provided below as well as in U.S. Pat. Nos. 6,974,705 and 7,111,503, which are incorporated herein by reference in their entireties.

Figure 3A:
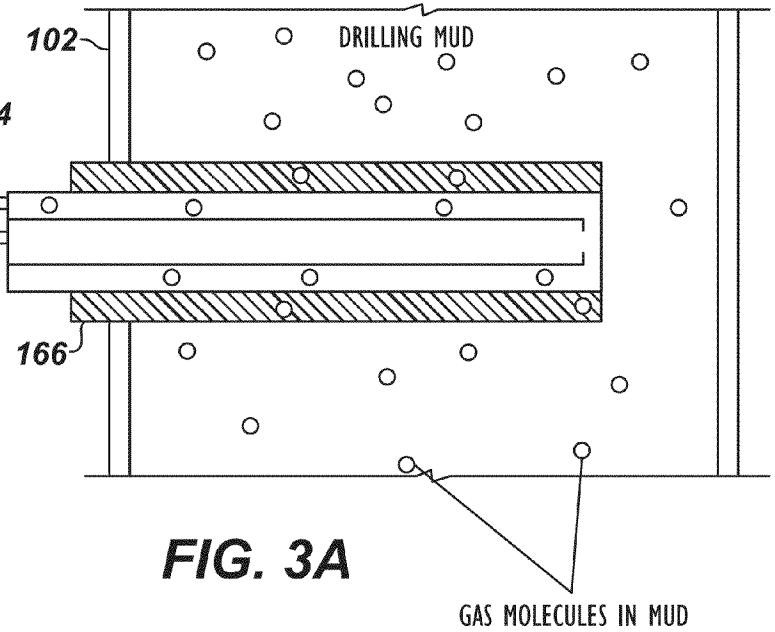
FIGS. 3A-3C shows a membrane-based gas extraction probe for the gas evaluation device.
Figure 3C:
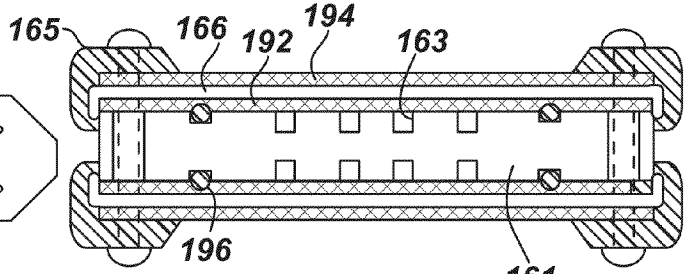
Figure 3D:
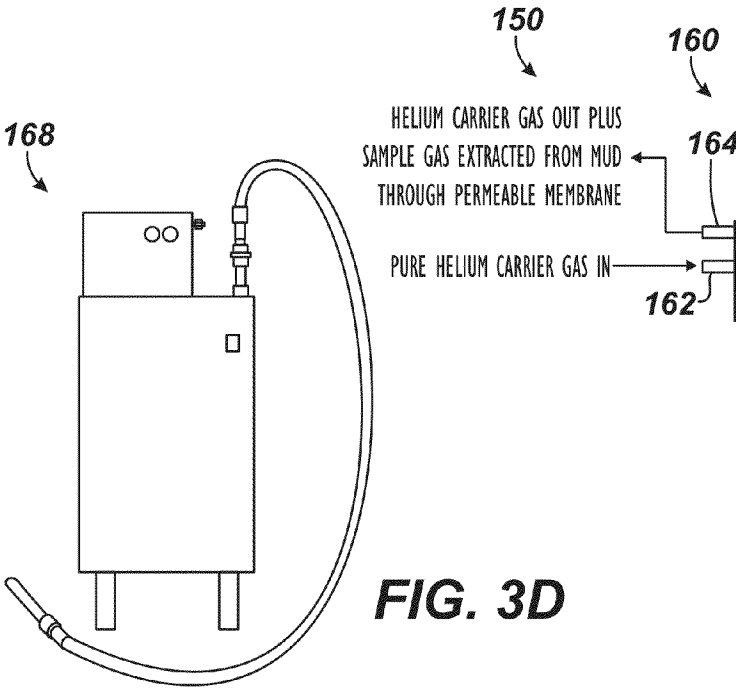
FIG. 3D shows an enclosure for a gas chromatograph for the gas evaluation device.
Figure 3B:
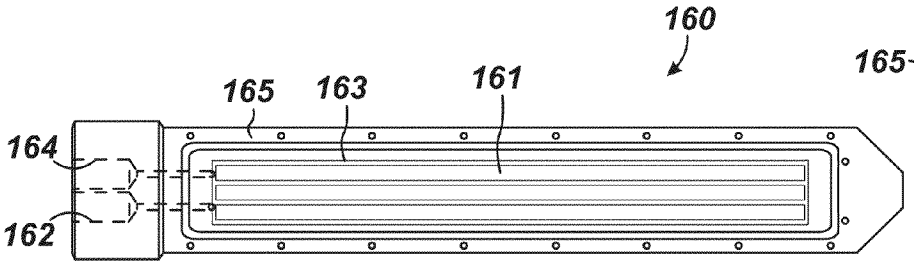

FIGS. 3A-3C show a membrane-based gas extraction probe 160 for use with the gas evaluation device 150 of the present disclosure. FIG. 3D shows a gas chromatograph 168 for the device 150 in an enclosure. As shown in FIG. 3A, the probe 160 has a semi-permeable membrane 166 that inserts directly in the flow line 102 (typically orthogonal to the fluid flow to maximize extraction efficiencies). The membrane 166 extracts gases from the drilling mud by exploiting differences in partial pressure within the probe 160 and the drilling mud in the flow line 102. This pressure differential allows a wide range of hydrocarbon and non-hydrocarbon gases, free or dissolved, to permeate across the membrane 166.

A carrier fluid or gas from an inlet 162 continuously sweeps the membrane 166 to transport the sampled gas out of an outlet 164. Passing through sample lines (not shown) from the probe 160, the carrier and sample gases pass to the device's gas chromatograph 168 in FIG. 3D housed separately in the enclosure.

The removal of the hydrocarbons within the carrier gas maintains the pressure differential and the sample lines are typically heated to ensure high resolution of heavier gas components. The probe's closed flow system eliminates dilution of gas samples with air (a major drawback of the gas-trap system), ensuring better accuracy of the samples. Typically, the enclosure for the gas chromatograph 168 is situated 10 ft (3 m) from the probe 160, providing a short transit time for the sample gases and reducing lag time. Preferably, the carrier gas for the probe 160 is helium, though hydrogen and argon may also be used.

During the drilling operation, gas in the drilling mud downstream from the choke manifold (100) passes through the flow line 102 and permeates across the membrane 166. Carried then by the carrier gas and sample lines, the extracted gas reaches the gas chromatograph 168 to be analyzed. The quantitative nature of the extraction provides accurate and rapid gas analysis.

The probe 160 is typically operated with a backpressure provided by the carrier gas from the inlet 162. Because the probe 160 is disposed in the flow of drilling mud having a pressure (that can be as high as about 125 psi, for example), the carrier gas would ordinarily need to balance this; however, modifications made to the probe's construction (detailed below) provide improved support for the membrane 166 and allow the probe 160 to operate with the carrier gas at standard pressures of up to 4.5 psi. Preferably, the membrane 166 of the probe 160 is strong enough to survive in the fluid flow for a suitable period and can withstand encounters with fluid and cuttings in the flow.

As shown in FIG. 3D, the high-speed micro gas chromatograph 168 is housed inside an enclosure. The gas chromatograph 168 analyzes the gas samples from the probe 160. In general, the chromatograph 168 can be configured to analyze hydrocarbon gases ranging from methane (C1) to octane (C8) as well as nitrogen ($N_2$), carbon dioxide ($CO_2$), benzene and toluene in under 60 seconds. In addition, the gas chromatograph 168 can be configured to analyze methane (C1) to decane (C10) in approximately 135 seconds. These time limits are only meant to be exemplary and can differ higher or lower depending on the implementation and equipment capabilities.

The gas chromatograph 168 can also be configured to analyze hydrocarbons higher than C10 and can be configured to analyze non-hydrocarbon gases, including carbon dioxide, nitrogen, and aromatic hydrocarbons (benzene, toluene, ethyl benzene and xylene). Post-analysis, the raw data is transferred using wired or wireless link over TCP/IP or other communication protocol to the data acquisition system (170; FIG. 1B) or the like.

1. Probe Details

As noted above, details of the membrane-based gas extraction probe 160 suitable for the disclosed techniques can be found in U.S. Pat. Nos. 6,974,705 and 7,111,503. Preferably, modifications to the probe 160 improve the membrane's performance at the higher pressures typically found within MPD and UBD systems. Particular details of the membrane-based gas extraction probe 160 are shown in FIGS. 3B-3C. The probe 160 includes an outer steel mesh layer 194 on the surface of the membrane 166 to improve the membrane's life expectancy. The mesh layer 194 helps to alleviate wear on the surface of the membrane 166 by formation cuttings carried in suspension within the drilling fluid.

The outer mesh 194 also increases the rigidity of the membrane 166, which is required due to the increased flow rates experienced within the surface pipework in comparison to more conventional deployments. The mesh 194 helps resist the membrane 166 attempting to pull out from under clamps 165 holding it in place. In addition to the outer mesh 194, the membrane 166 has an increased overlap at the edges under the perimeter clamps 165 to also alleviate the pull of the membrane 166 out of the clamps 165.

A relief 163, which may comprise channels, is defined in the platen area of the main body 161 of the probe 160. This relief 163 improves flow characteristics away from behind the membrane body 190. Another steel mesh 192 underlies the membrane 166 and provides support above the platen relief 163 to improve the flow characteristics at higher pressures.

2. Purge System

Due to the characteristics of the membrane material, the efficiency of the transition of hydrocarbons from the drilling fluid is greater for heavier hydrocarbons. This has the potential for generating condensation within the gas lines of the gas evaluation device 150, due to differences in ambient temperature and increased partial pressures within the gas lines. To alleviate any issues with condensation that can create blockages within the system, the gas evaluation device 150 includes a purge system 180 as detailed in FIG. 4. The purge system 180 is coupled to the probe 160 via umbilical gas lines of the device 150.

The purge system 180 includes a pneumatic control module 182 connected to a purge circuit enclosure 184 by tubing 183. The enclosure 184 houses valves 186-1 and 186-2, a fluid trap 185, a pressure gauge 187, an exhaust vent 189 with a flame arrestor, and a regulator 188 with a set pressure between 0 and 140 psi. The valves 186-1 and 186-2 may be ball valves. The enclosure 184 connects to a helium supply source via tubing and connects to the probe 160 via a dual line hose. Connection to the probe 160 can be incorporated directly into the supply line for the carrier gas and sample line used for the gas chromatograph (168) connected to the probe's ports 162/164 or can be made by ancillary connections to the probe's ports 162/164.

Figure 4:
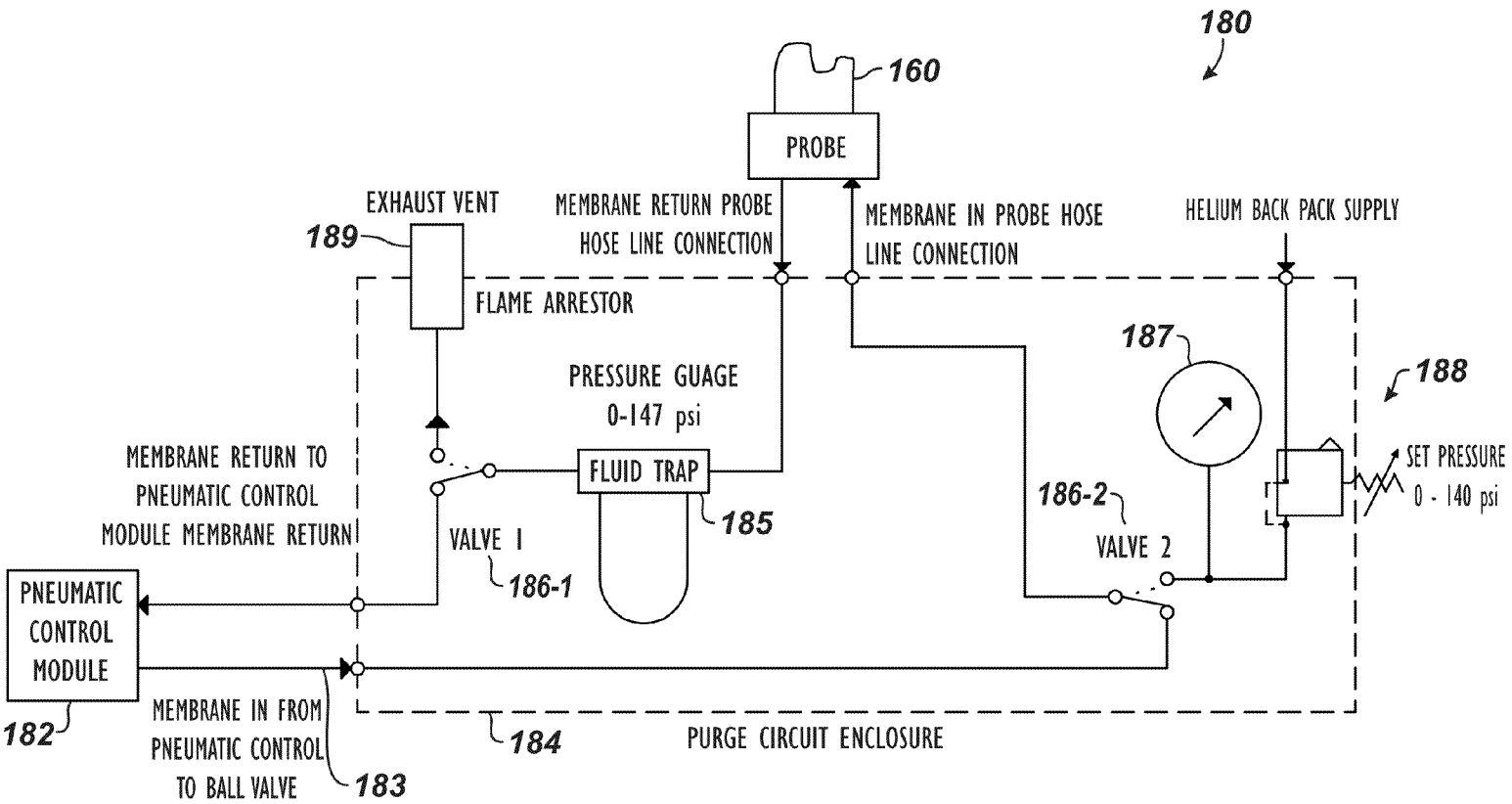
FIG. 4 shows a purge system for the membrane-based gas extraction probe of the present disclosure.

During operations, the pneumatic control module 182 operates the purge system 180 pneumatically via return and supply and routinely purges the probe 160. As depicted in FIG. 4, the first valve 186-1 is shown in its normal position, and second valve 186-2 is shown in its purge position. When commencing the purge operation, the first valve 186-1 is switched to its purge position before the second valve 186-2 is operated. When ending the purge operation, the first valve 186-1 is switched back to its normal position shortly after the second valve 186-2 is returned to its normal position.

Any fluids that may otherwise cause blockages are caught in the fluid trap 185, which preferably has an accessible drain. During operation, the pressure of the regulator 188 is increased gradually and then returned to zero afterwards. Yet, the maximum pressure on the regulator 188 is set to not exceed the pressure in the drilling mud flow line by more than some predetermined amount (i.e., 20 psi) to avoid damaging the probe's membrane (166). The purge system 180 may be run manually or configured for automatic operation with a preset time for purging.

3. Piping Arrangement

Figure 5A:
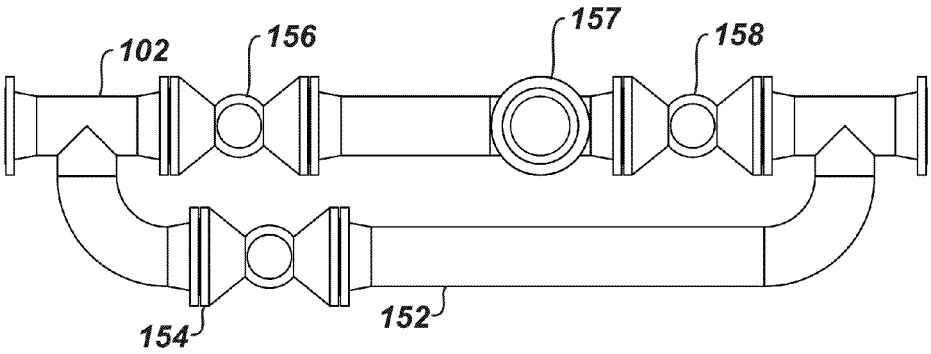
FIGS. 5A-5B shows a piping arrangement for the membrane-based probe.
Figure 5B:
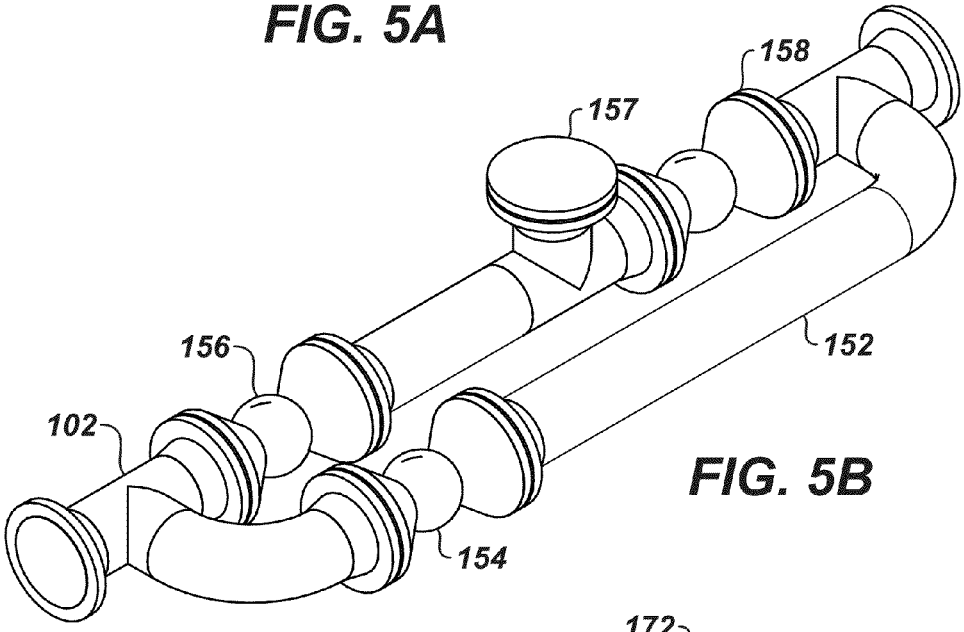

As shown in FIG. 1B, the probe 160 of the gas evaluation device 150 installs in the flow line 102 using a piping arrangement and flange, details of which will now be discussed. For example, FIGS. 5A-5B show a piping arrangement for the gas evaluation device 150. The probe (160) mounts on a 6" 150# flange 170 shown in FIG. 5C along with integral temperature compensation and pressure monitoring sensors (not shown). In turn, this flange 170 mounts on a complementary flange 157 on the flow line 102. A bypass pipe 152 disposed off of the flow line 102 allows the probe 120 to be isolated from the flow by closing off valves 156/158 so the probe 160 can be repaired and installed when necessary with no effect upon drilling. The pipe 152 can be isolated from the flow line 102 by another valve 154.

Figure 5C:
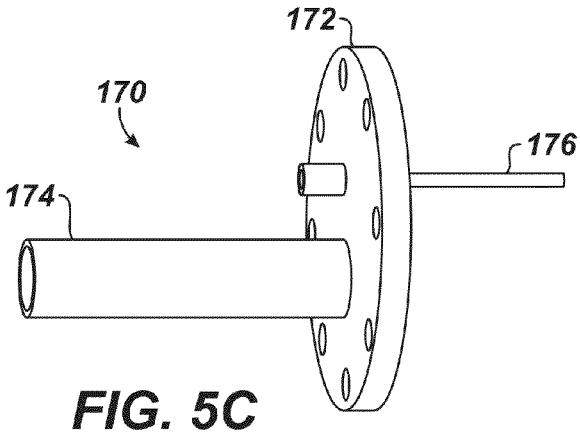
FIG. 5C shows a flange for holding the membrane-based probe.

The flange 170 in FIG. 5C has a cylindrical extension 174 for holding the external portion of the probe (160) so that the membrane (166) can extend exposed beyond the other side of the flange 170 and into the flow line (102). The flange 170 also has an internal tube 176 that extends into the flow line (102) for holding sensors, such as temperature and pressure sensors for the fluid flow.

4. Other Gas Sensors

Although the discussion above has focused on using a membrane-based gas extraction probe 160 inserted in the flow line 102 to obtain gas samples and a gas chromatograph 168 to obtain gas readings, the system 10 can use other types of sensors and tools for analyzing gas. For example, samples of the drilling mud can be routed or purged to an evaluation device separate from the flow line 102 that analyses the fluid and determines the gas in the drilling mud. This evaluation device can use a gas chromatograph that does not use a membrane to extract gas, but instead uses another technique available in the art. In addition, this device could also be an optical based device that interrogates the drilling mud sample optically to determine its gas content.

In addition to the gas evaluation device 150, the system 10 can use a mass spectrometer to determine the carbon isotopic variations of the gas (i.e., Carbon-12 and Carbon-13 isotopes) in the drilling mud. Moreover, mud logging sensors can also be used at the location of the gas evaluation device 150 to obtain additional information.

D. Factors in Using Gas Evaluation Device in System

Processing of the gas readings obtained with the gas evaluation device 150 (and especially the membrane-based probe 160) in the system 10 preferably accounts for several factors to help properly quantify the readings. One factor involves the gas solubility of dissolved gases in the drilling mud being measured. Other factors involve the effect of temperature upon gas solubility, the effect of pressure upon gas solubility and transition across the probe's membrane (166), the flow rate across the membrane (166), and the ratio of free phase to dissolved gases in the drilling mud. These factors are discussed below.

1. Temperature Effects on Readings

Readings obtained by the gas evaluation device 150 can be influenced by temperature based on how temperature can alter gas solubility within the drilling fluid. Therefore, the gas evaluation device 150 uses a temperature probe 172 (FIG. 1B) to monitor the mud temperature at the location of the device 150. In particular, for the membrane-based gas extraction probe 160, the temperature reading provides an input to correct the gas extractions at different temperatures and corresponding solubilities. In general, the temperature profile for the probe 160 can be characterized for known amounts of particular gases in particular types of drilling mud. In general, readings for hydrocarbons increase with temperature in an exponential type function because there is a decrease in solubility with an increase in temperature. In addition, readings for the heavier hydrocarbons increase more rapidly with temperature than the lighter hydrocarbons. The particular behaviors can be mathematically modeled and used during processing of raw data to correct for the temperature effects on the readings obtained with the gas evaluation device 150.

2. Pressure Effects on Readings

Figure 6:
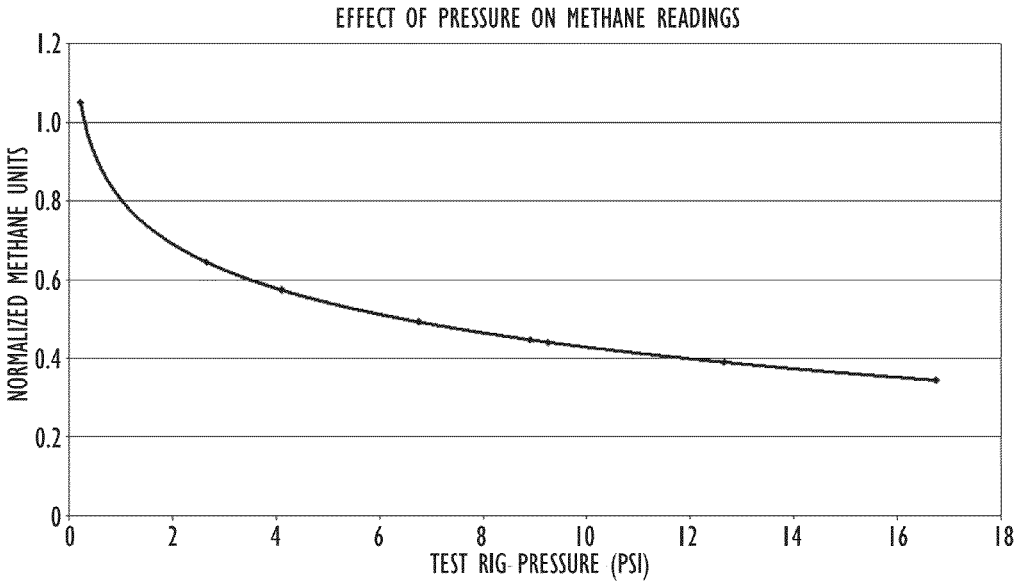
FIG. 6 shows an example test indicating the effect that pressure can have on methane readings by the gas evaluation device.

Pressure has a negative effect upon the gas readings at surface by the gas evaluation device 150. FIG. 6 shows an example test indicating the effect that pressure can have on methane (C1) readings by the gas evaluation device 150. In general, the increase in pressure increases the solubility of the gas in the drilling mud. For the membrane-based gas extraction probe 160, there may also be an effect upon the gas transition efficiency through the membrane. These effects can be quantified to provide correction factors. Then, the gas evaluation device 150 uses pressure readings from a pressure sensor 174 (FIG. 1B) so the values of the gas readings taken downstream from the choke manifold 100 can be corrected based on the known effects of pressure.

3. Flow Effects on Readings

Figure 7:
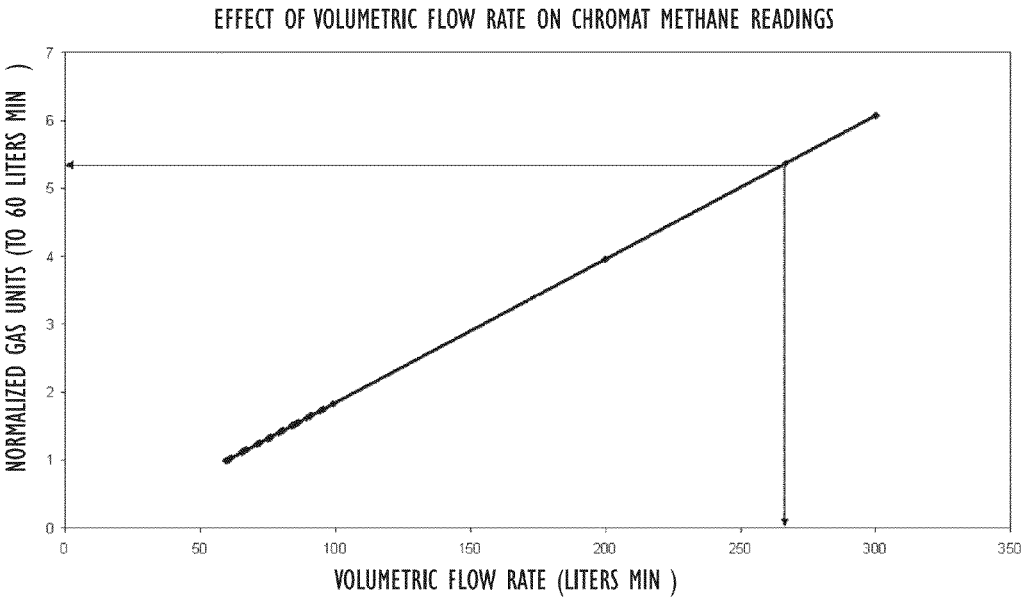
FIG. 7 shows an example test indicating the effect that flow can have on methane readings by the gas evaluation device.

Flow has a positive effect upon the gas readings at surface by the gas evaluation device 150. FIG. 7 shows an example test indicating the effect that flow can have on methane readings by the gas evaluation device 150. Gas readings increase with flow velocity above the membrane interface. For the membrane-based gas extraction probe 160, this results in an increase in gas passing over the membrane 166 in relation to the flow of the helium carrier gas behind the membrane 166. In effect, more gas is liberated per unit of time and results in apparent higher gas concentrations, and the effect of flow within the parameter encountered appears linear. Again, these effects can be quantified to provide correction factors. Then, the gas evaluation device 150 uses the flow readings from the flow meter 112 so the values of the gas readings taken downstream from the choke manifold 100 can be corrected based on the known effects of flow on the readings.

4. Effect of Free Gas on Readings

The concentration of free gas in the drilling mud passing the gas evaluation device 150 can also have an effect on the gas readings obtained. For the membrane-based gas extraction probe 160, the transition of gas across the membrane 166 is related to the medium in which the gas is contained. Solubilities for differing mediums are calculated and incorporated within processing algorithms for the device 150. In air, for example, effective solubility is zero, so free phase gas in contact with the membrane 166 generates a higher signal response.

In the gas cut muds encountered during drilling, the effect of free gas concentrations on the gas readings can be significant. However, the response is entirely repeatable and predictable so it can be characterized to determine correction factors for the various gases and types of drilling mud involved. First, the ratio of free gas to mud volume can be determined. Then, the amount of gas in free phase can be calculated simply by knowing the gas type and the density of the fluid at the time of the gas cut. Formation of free phase gas becomes significant when the gas content of the mud exceeds approximately 15%. The proportion of free phase gas will modify the effective solubility of the gas, which would lead to overestimation of gas in mud content unless a correction is done.

Figure 8:
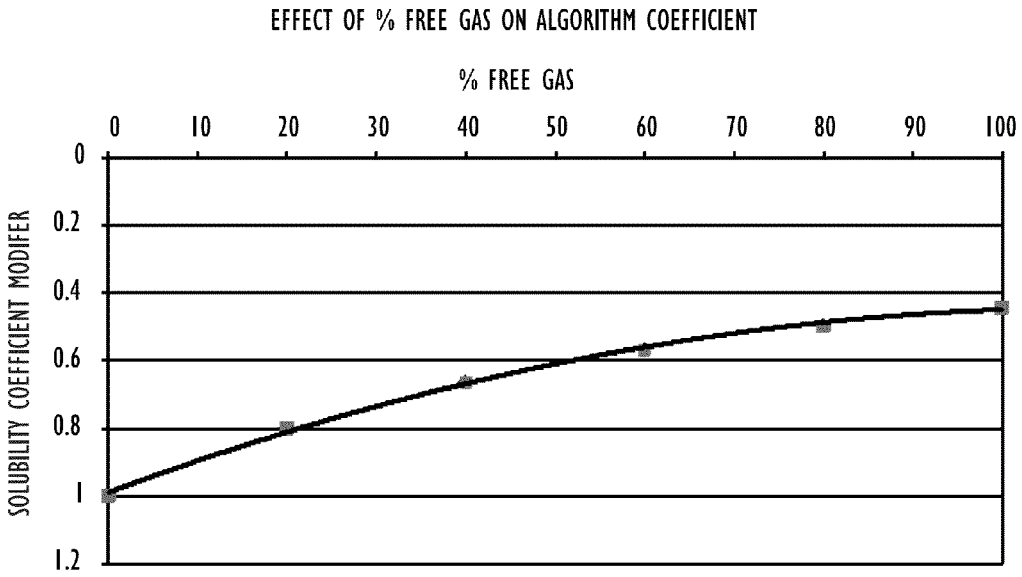
FIG. 8 graphs a relationship between a solubility coefficient modifer and the concentration (%) of free gas present.

The effect of the free gas content can be characterised to provide a modifier that can be applied to a gas solubility coefficient for correcting the gas readings obtained by the gas evaluation device 150. FIG. 8 graphs a relationship between a solubility coefficient modifer and the concentration (%) of free gas present. Alternatively, with the gas composition known, it can be partitioned based upon the ratio of free to dissolved gases calculated from the density variation. The partitioned components can then be treated separately in terms of the solubility algorithms applied before the two components are recombined to provide a total gas content of the drilling fluid.

5. Other Factors

Operation of the gas evaluation device 150 can be characterized for additional factors, including pH, oil-to-water ratio, flow velocity, and viscosity, for example. Because the gas evaluation device 150 is downstream from choke manifold 100, it will experience certain pressure drops and temperature changes different from the actual values of the drilling mud flowing out of the well. Therefore, the device 150 can use the pressure and temperature sensors to account for these effects. Even though the membrane-based gas extraction probe 160 is well suited for this location behind the choke manifold 100, a robust gas evaluation device 150 could be used upstream from the choke 100 or even in the wellbore. In such a location, certain adjustments for pressure and temperature may or may not be needed.

6. Connection Gases

As is known, "connection gas" refers to gas entering the wellbore when the mud pumps are stopped so operators can make a connection on the drillstring. The gas can enter the wellbore because the bottomhole pressure decreases when the pumps have been stopped. A "dummy connection" refers to the drillstring being lifted off bottom and the pumps being stopped. In addition, operators may perform swabbing or lifting of the drill string rapidly off bottom at times. As a result, the borehole pressure drops and encourages formation fluids to flow into the wellbore. The resulting gas from this swabbing can then be used to evaluate the formation.

When they occur, connection gases may indicate that the pressure exerted by the mud column in the wellbore is close to the pore pressure of the formation downhole. Therefore, taking into account the magnitude of connection gas released along with other variables, such as depth of hole, differential pressure, formation permeability, type of gas detected, time in which pumps turned off, etc., the information from connection gas events can be used to characterize aspects of the formation.

Figure 9A:
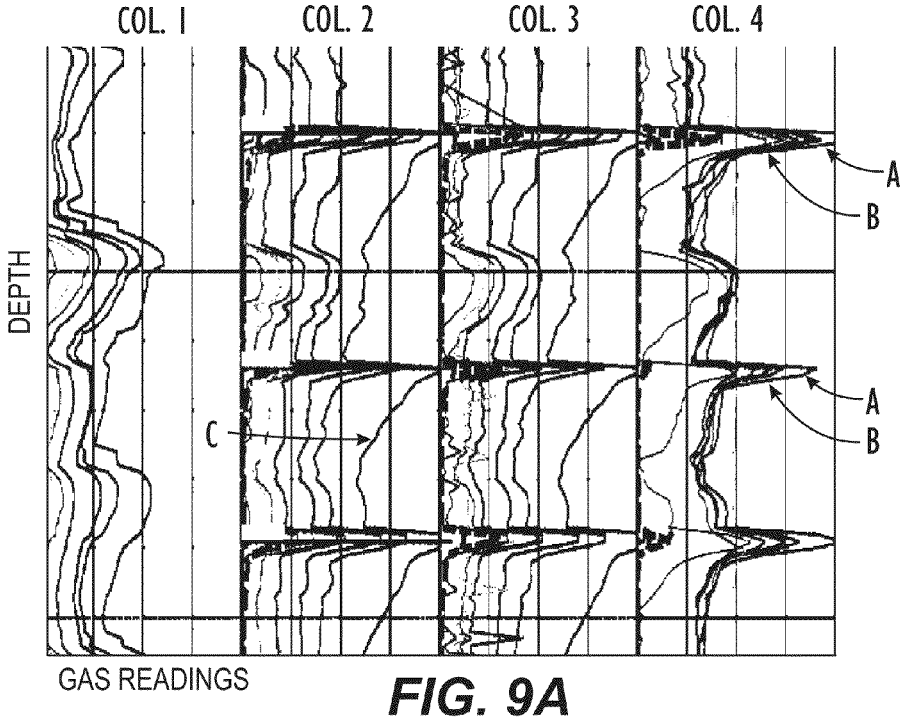
FIG. 9A compares connection gas events that may occur during drilling operations when a gas trap type of system is used and when the disclosed gas evaluation device is used.

As shown in FIG. 9A, significant connection gas events may occur during drilling operations. Such events will require extensive use of the gas separator 120 to remove the gas from the drilling mud before it is reused. Gas readings for the "flow in" are shown in the first column (col. 1), while gas readings from the "flow out" obtained with a conventional gas trap system are shown in the second column (col. 2). Readings from the gas evaluation device 150 having a membrane-based gas extraction probe 160 are shown in the fourth column (col. 4). As shown in the fourth column (col. 4), the membrane-based probe 160 produces defined peaks at (A) with sharp drop offs at (B) in the gas readings as the connection event is circulated through the system. As shown in the second column (col. 2), the conventional gas trap system introduces a prolonged tailing off at (C) of the connection gases that overlay readings of subsequent drilled gas. This tailing off at (C) of the connection gases leads to an erroneous gas signature for up to 60% of the depth interval between connections. Yet, the membrane-based gas extraction probe 160 used in the fourth column (col. 4) does not suffer from this issues so it can better characterise the drilled formation between gas events. Having a faster cycle time of just 25 seconds for gas in the C1 to C5 range shown in FIG. 9A, the membrane-based gas extraction probe 160 provides depth resolution that is greater than the conventional system in the second column (col. 2) at 60-sec.

Figure 9B:
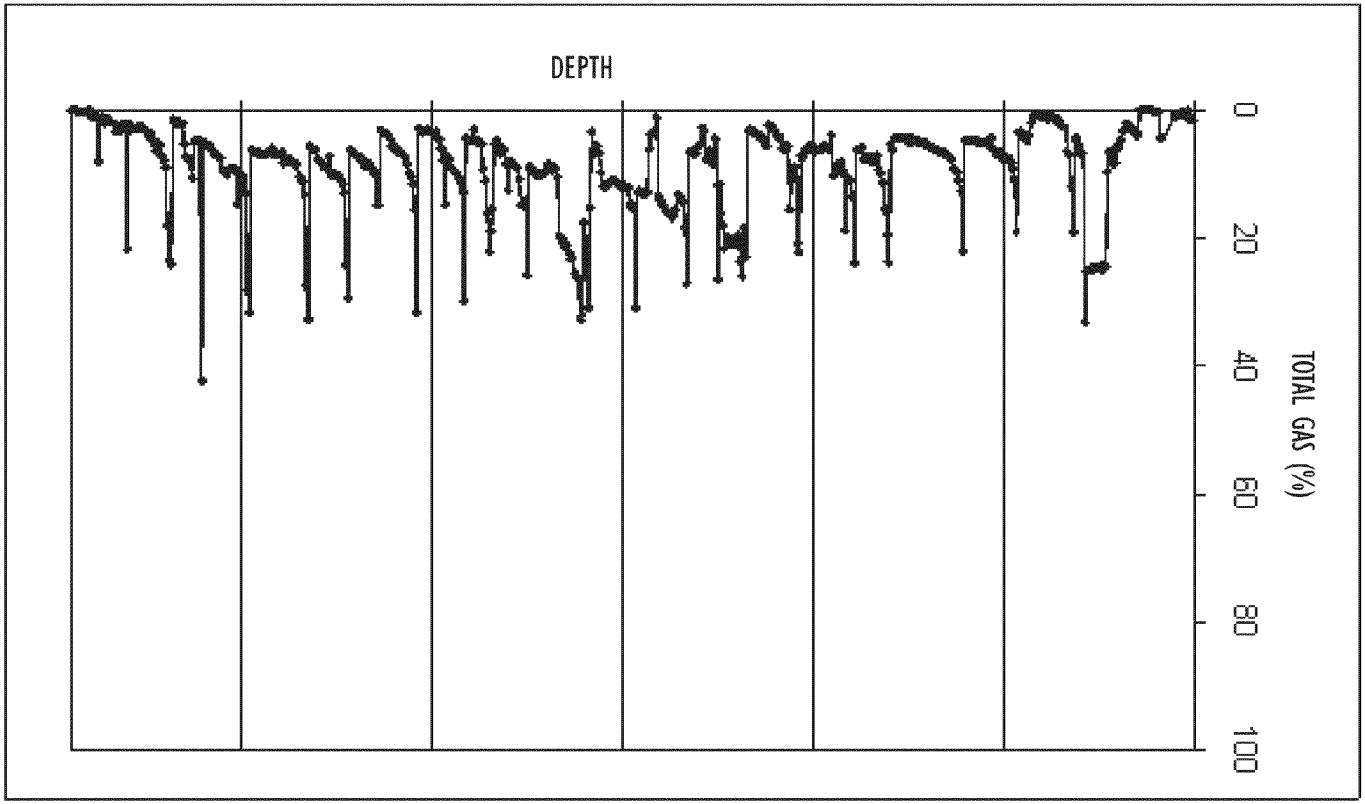
FIG. 9B plots an example of total gas values from a constant volume trap system.

Overall, the conventional gas trap type of system reports the presence of more gas because the conventional system's form of gas extraction is inconsistent and tends to over respond to methane (C1). Moreover, the conventional system has the tailing off after connection gas events noted previously because the system is saturated and takes time to normalize. FIG. 9B plots an example of total gas values from a constant volume trap system. As this plot indicates, constant volume trap system overprints connection gas events.

In fact, a test of the fluid composition for C1 to C5 has been performed by (1) using the gas evaluation device 150 of the present disclosure during drilling of a target well to measure gas readings, (2) using a conventional gas trap type of system during drilling of the target well to measure gas readings, and (3) using well logging techniques of an offset well to the target well to measure gas readings of the same underlying formation. The test results show that the gas readings from the gas evaluation device 150 correlate quite accurately to the gas readings obtained by logging the offset well. Yet, the conventional system highly overestimated the content of C1 and underestimated the content of the high hydrocarbons of C2, C3, iC4, nC4, iC5, and nC5.

E. Correlations Between Gas Readings and Drilling Readings

Figure 10A:
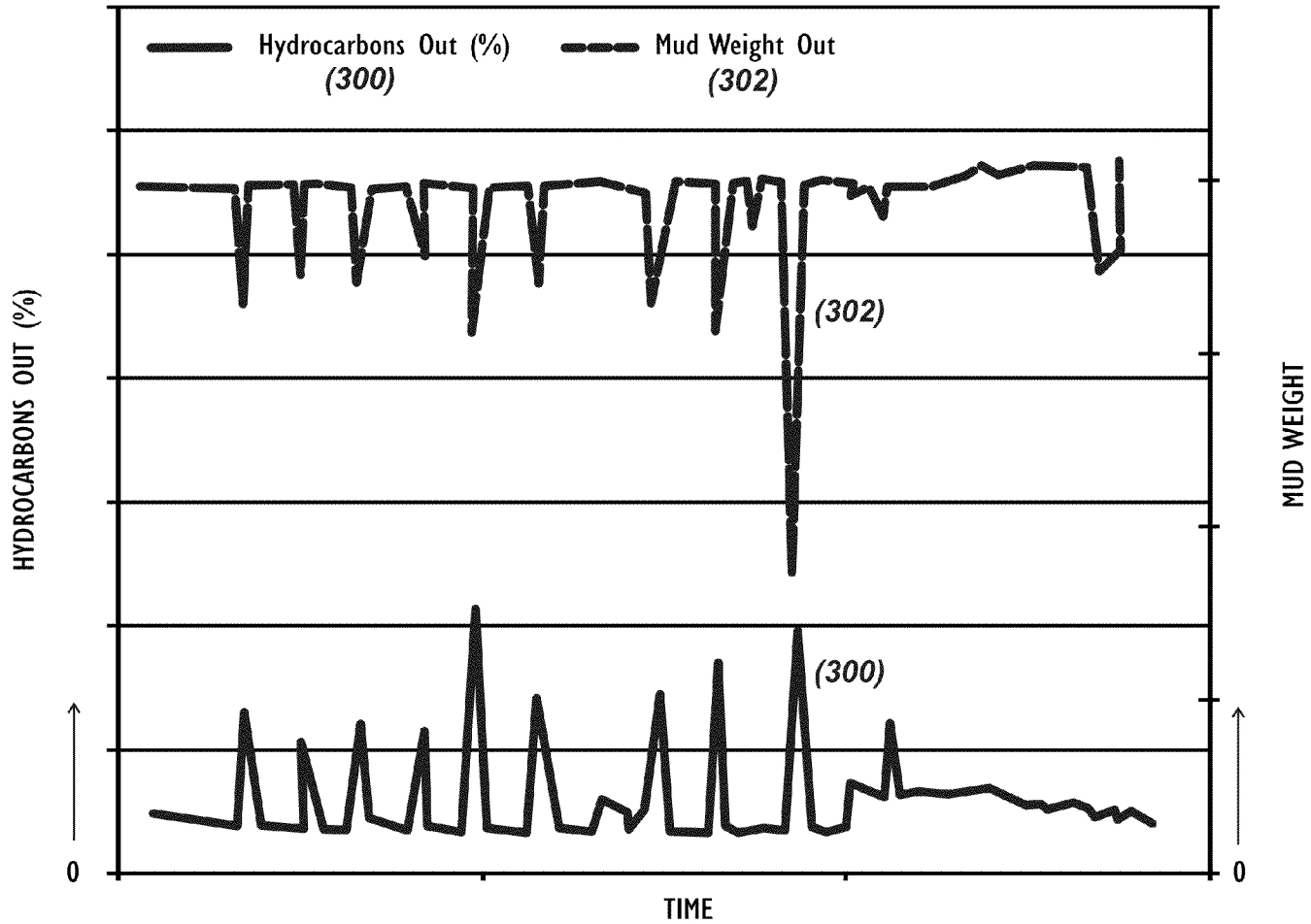
FIGS. 10A-10B graph correlations between gas readings from the gas evaluation device and mud weight readings from the drilling system.

FIG. 10A graphs a correlation between gas readings from the gas evaluation device (150) and mud weight readings from the managed pressure drilling system (10) having the choke manifold (100) and other components. The resolution of both systems with high data density is comparable, which facilitates the correlation. In this graph, the gas readings at the surface are presented in the form of a concentration (%) of hydrocarbons out (300), and the mud weight readings are generically presented in the form of mud weight (g/cc) (302).

In certain sections of the well during drilling, considerable gas cut may be seen at surface. This may occur in response to a gas influx during connections and dummy connections. The gas influx then arrives at surface as sharply defined gas events. As a result, surface gas results from the gas evaluation device (150) register a rapid rise in gas values with gas peaks of up to 25% as these connection gas events are circulated to surface. At the same time, a decrease in mud weight is registered by the drilling system (10). An example of such events can be seen in the graph of FIG. 10A.

In this plot, the total hydrocarbon reading from the gas evaluation device (150) is plotted against time in comparison to the variation in mud weight determined from the drilling system (10). From this time plot, the relationship between the total gas content of the mud (300) and the mud density (302) can be seen. For example, the mid section of the plot is characterized by short, sharp "pump off" gas events. This indicates that the gas content (300) is related not only to the timing of the variation in density (302), but also to the degree of variation in the density (302).

Figure 10B:
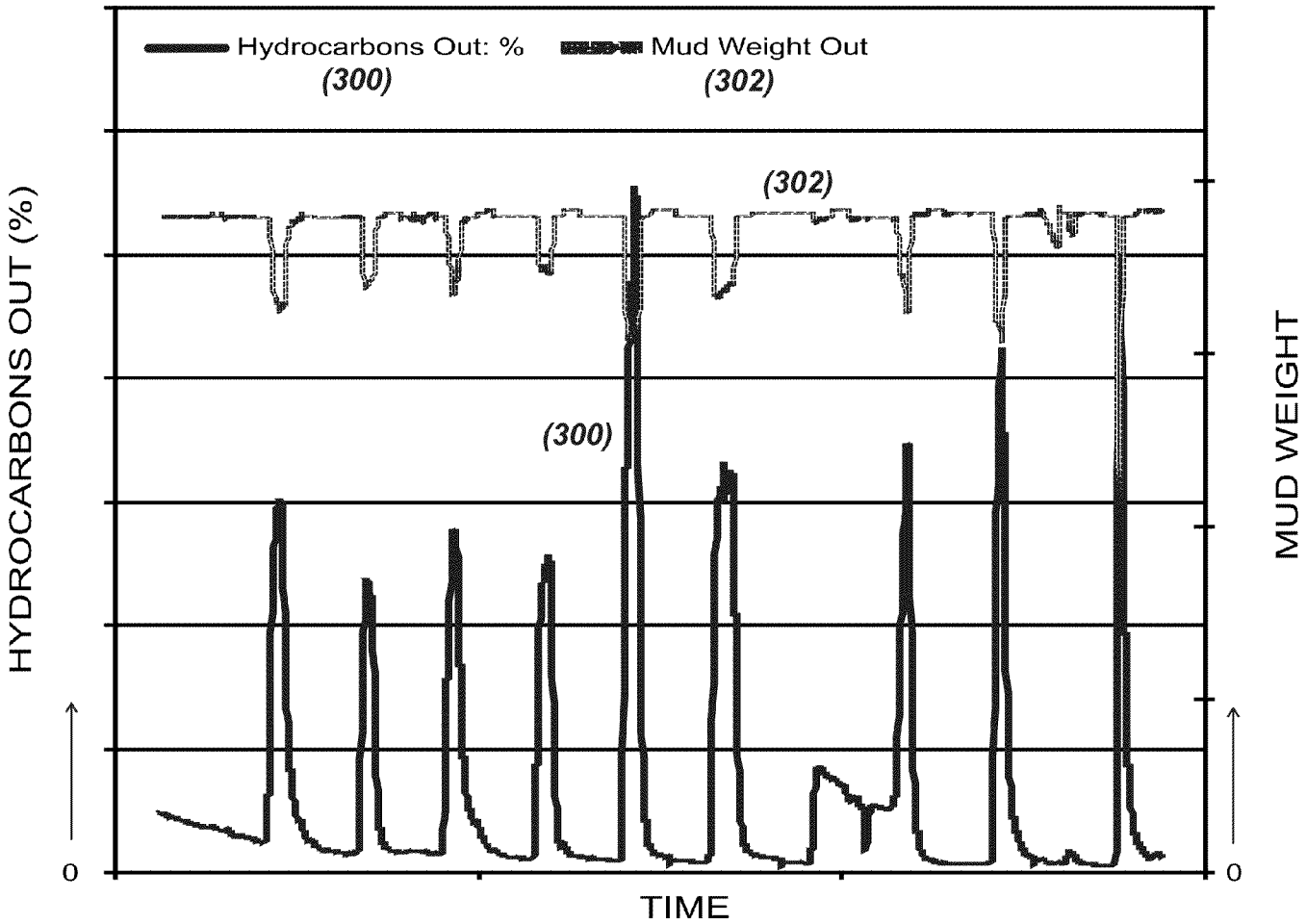

This is shown in greater detail in FIG. 10B for a series of "pump off" gas events. The regression of gas versus mud weight shows a relationship that exists between the two, indicating that both the gas evaluation device (150) and the sensors of the drilling system (10) can give clear indications of the extent of gas cut. Because values for the mud weight are necessary to quantify the free gas content in the mud, knowing that the gas readings from the device (150) and mud weight readings from the system (10) correspond in a defined relationship strengthens the reliability of the analysis and quantification of the fluid composition provided by the gas evaluation device (150) in the system (10).

Figure 11:
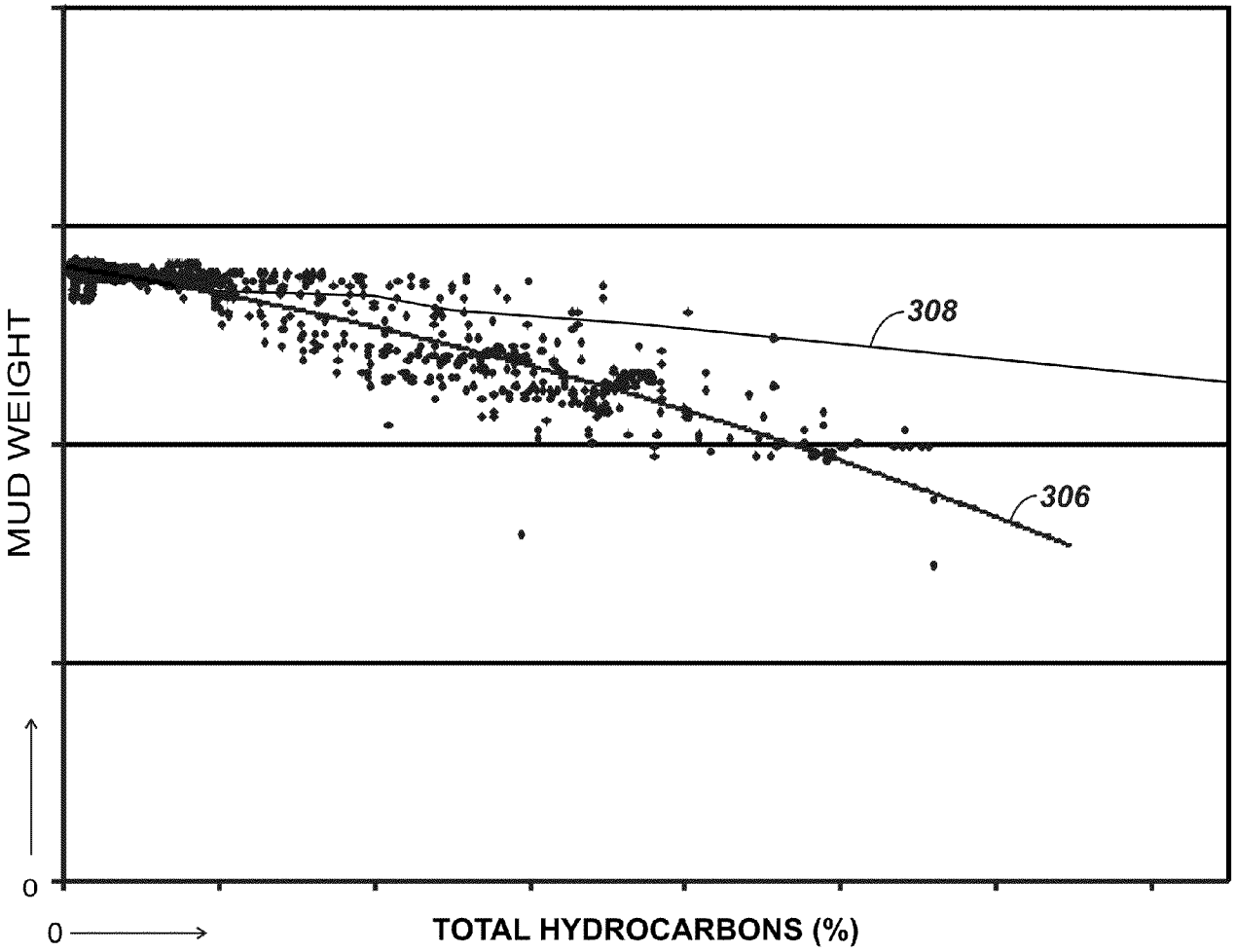
FIG. 11 shows a relationship existing between hydrocarbon concentration and mud density for the disclosed system.

In addition to the relationship shown above, FIG. 11 shows a cross plot of total hydrocarbon concentration (%) versus mud weight. The plotted data shows a relationship existing between hydrocarbon concentration and mud density. An interpreted curve (306) is shown relative to a theoretical relationship (308). The interpreted curve (306) indicates a nearly direct relationship between the hydrocarbon concentration and the mud weight. In fact, the relationship is close to linear but with a high degree of correlation of approximately 80%.

Below a 2% gas/vol mud, the resolution of the density readings appears to be limited. The limited resolution below 2% gas/vol mud may be caused by the sampling frequency of the gas evaluation device 150 or drilling system 10 or may be caused simply by natural variation within the fluid. The response below the 2% gas/vol mud may be improved if the system is configured to detect variations with a resolution of 0.1 g/cc, for example.

Figure 12A:
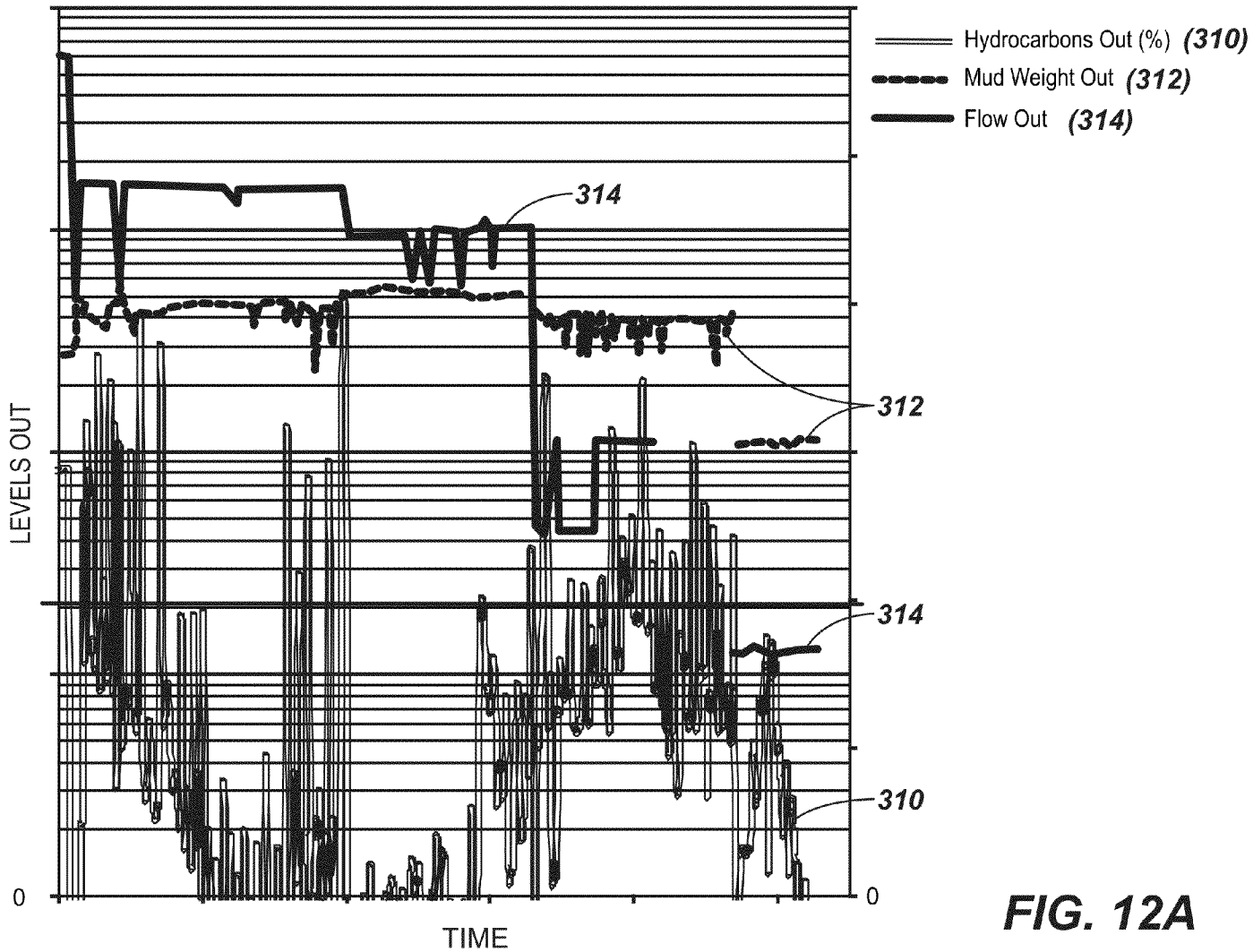
FIG. 12A illustrates a drilled section showing a concentration of hydrocarbons out, mud weight out, and flow out relative to one another.

In FIG. 12A, a drilled section is graphed showing the concentration of hydrocarbons out (%) (310), the mud weight out (mg/cc) (312) for the MPD system 10, and the flow out ($m^3$/min) (314) for the MPD system 10 relative to one another. As the graph shows, the relationship between density and gas concentration holds throughout the drilled section. In addition, the 2%/vol gas threshold on density is also evident in the graph.

As evidenced above, the gas evaluation device 150 functions in a proven way when used downstream from the choke manifold 100 and upstream of the gas separator 120 in the system 10 of FIGS. 1A-1B. For the membrane-based gas extraction probe 160, the membrane 166 has held up well under the conditions in the flow line 102 passing from the choke manifold 100. Any factors that influence the gas value (total gas value) read by the gas evaluation device 100 can be identified and characterised to correct the readings obtained. Finally, the gas concentration can be correlated to the fluid density measured during the MPD operation. Although the resolution below a 2%/vol gas appears to be limited for density measurements, the overall correlation is significant in characterising gas breakout at the surface and defining the degree of gas cut downhole.

Figure 12B:
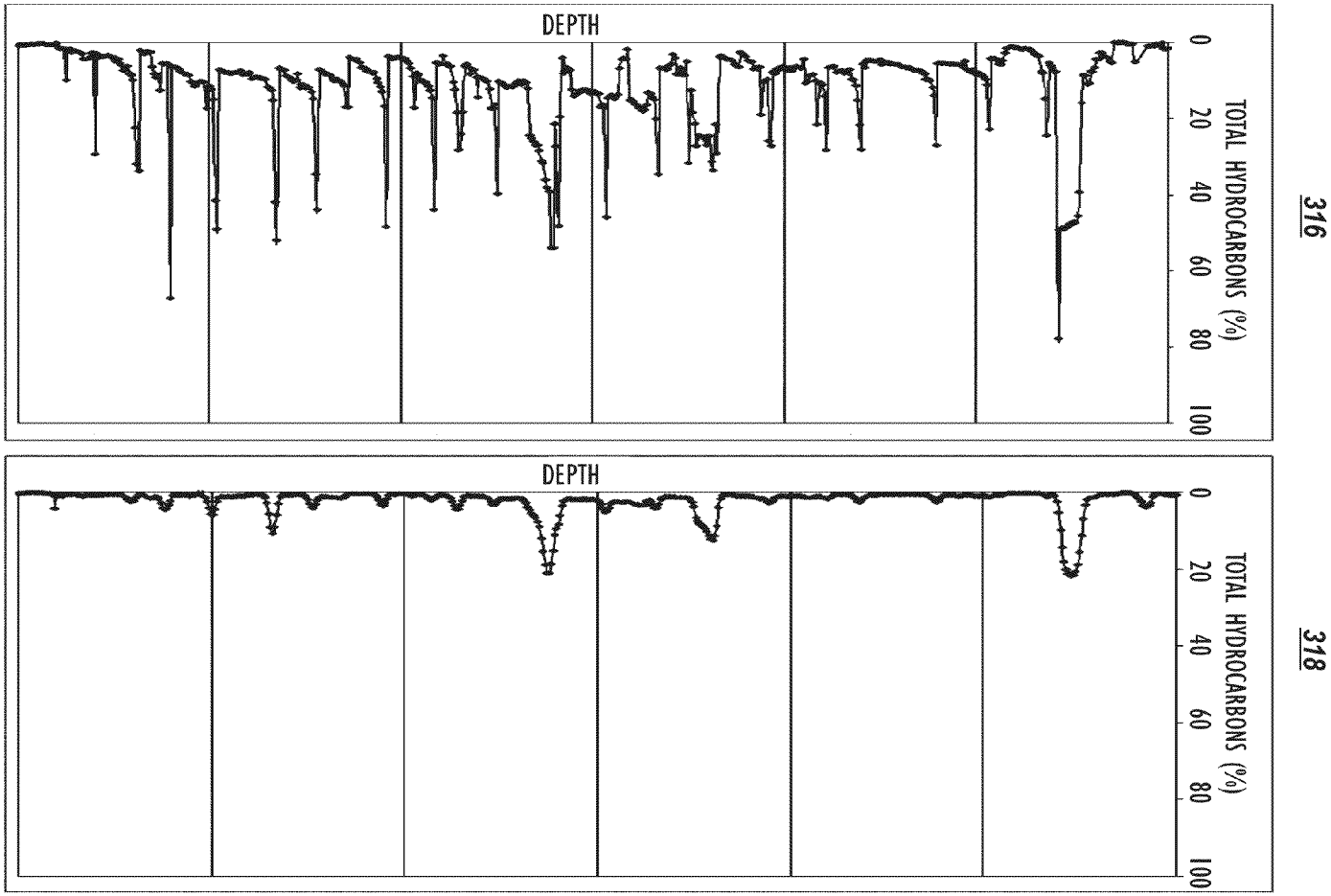
FIG. 12B shows unmodified gas chromatograph results for total hydrocarbon obtained in comparison to the results after modified to account for drilling parameters.

FIG. 12B shows a first graph 316 of unmodified gas chromatograph results for total hydrocarbon obtained in comparison to a second graph 318 of the results after modified to account for drilling parameters. The total hydrocarbon volumes in these graphs 316/318 were obtained using the membrane-based probe 160 as disclosed herein. The first graph 316 plots unmodified gas chromatograph results (Total Hydrocarbon (%) versus depth. The second graph 318 plots the same results after accounting for information from the drilling system (10), including the flow rate, the temperature, the pressure, and the mud type. Verification of the modified results in graph 318 indicates that it is more representative of the actual formation conditions downhole.

F. Formation Characterization Using Gas and Drilling Readings

As noted briefly above, correlating the gas readings from the gas evaluation device 150 to the drilling readings from the choke manifold 100 and other components of the system 10 can allow operators to characterize the formation during drilling. A number of these determinations are discussed below. These determinations are applicable to the MPD, UBD, and other controlled pressure drilling operations of the system 10.

1. Lithological Boundaries & Reservoir Contacts

Using the gas evaluation device 150 behind the choke manifold 100 provides well-defined gas signatures in response to changes in the formation. Using the gas readings from the device 150 allows operators to then accurately determine transitions in the formation. The clarity obtained can be comparable to what can be obtained using conventional LWD and WLL techniques.

Figure 13C:
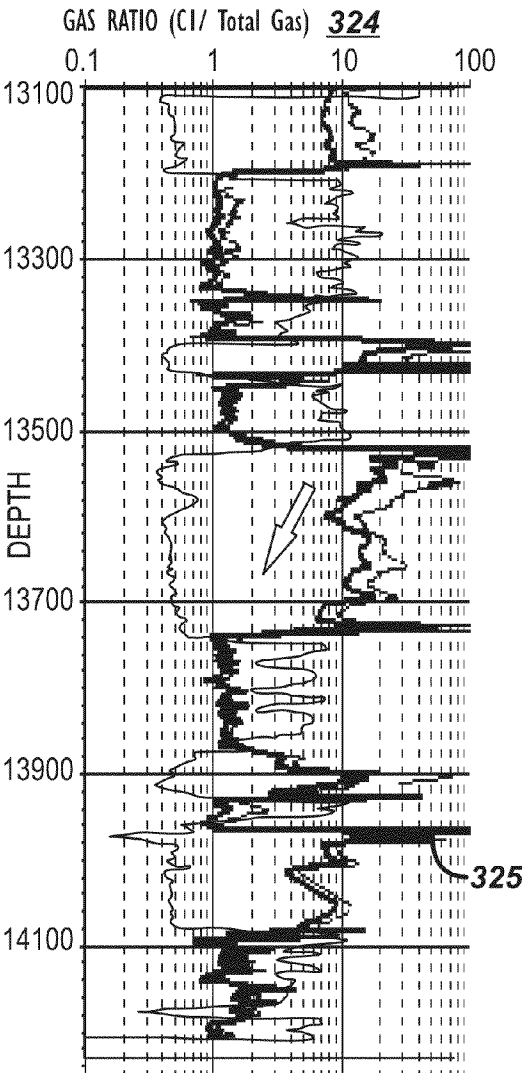
FIGS. 13A-13C show images of a formation overlain by gamma ray, a first gas ratio, and a second gas ratio for determining reservoir bounds.
Figure 13B:
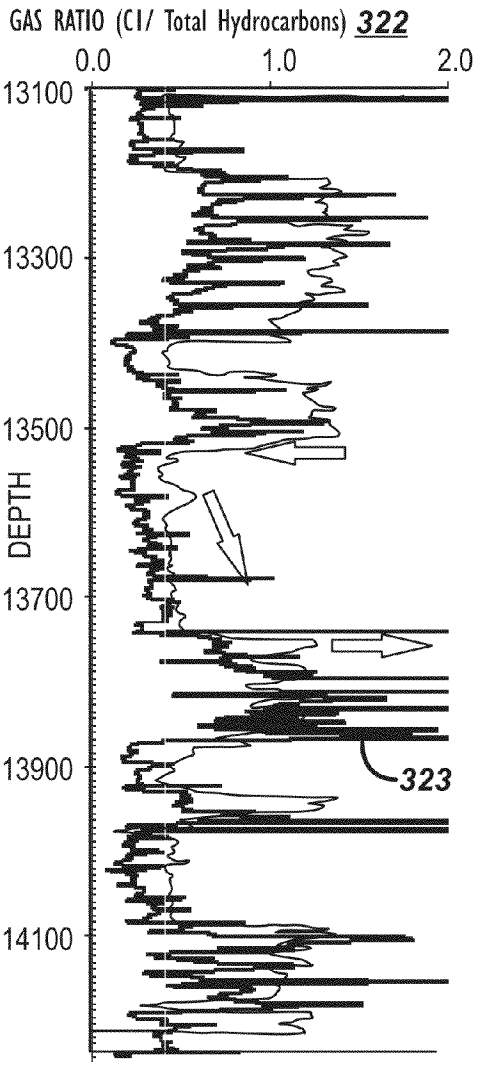
Figure 13A:
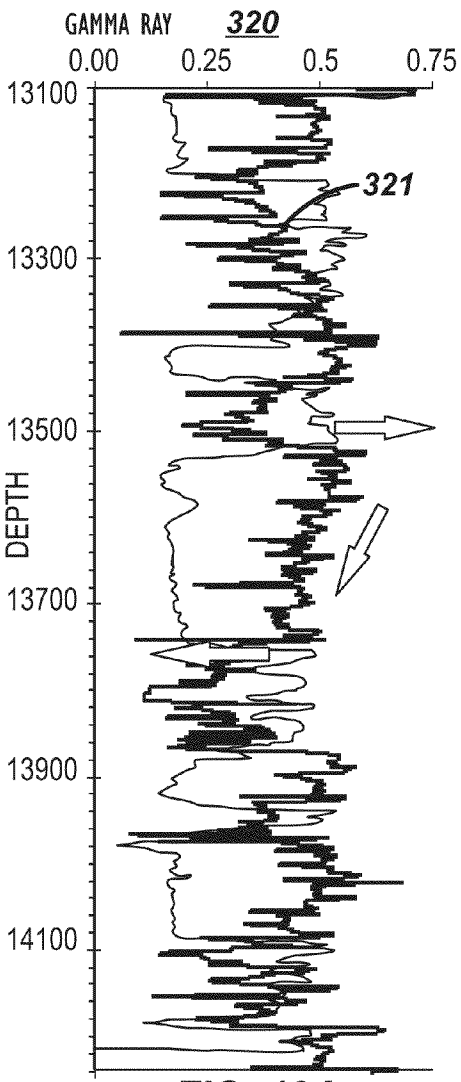
Figures 14A, 14B:
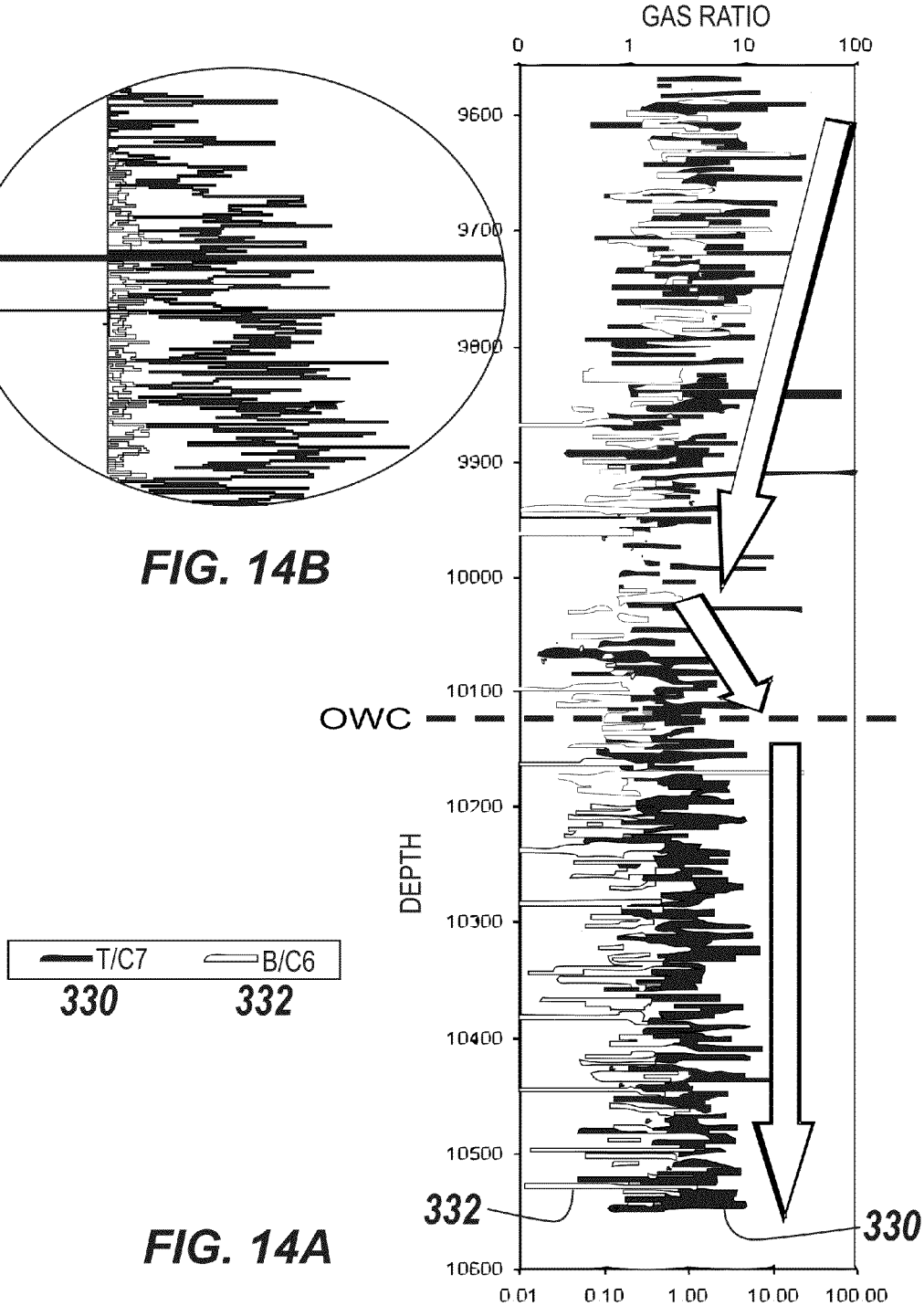
FIGS. 14A through 14D show gas ratios used to identify oil/water contacts and water saturation in a formation.
Figure 14C:
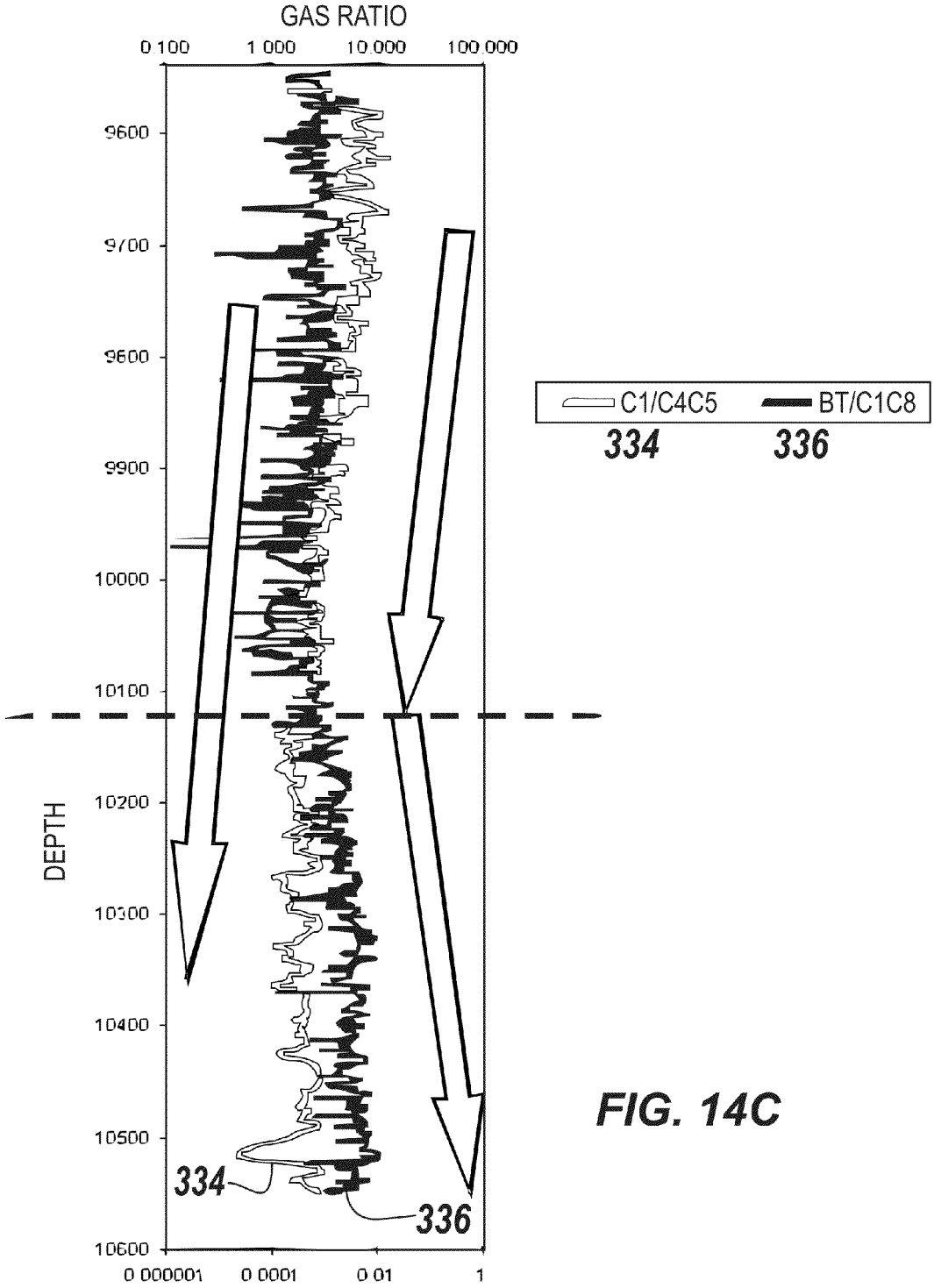
Figure 14D:
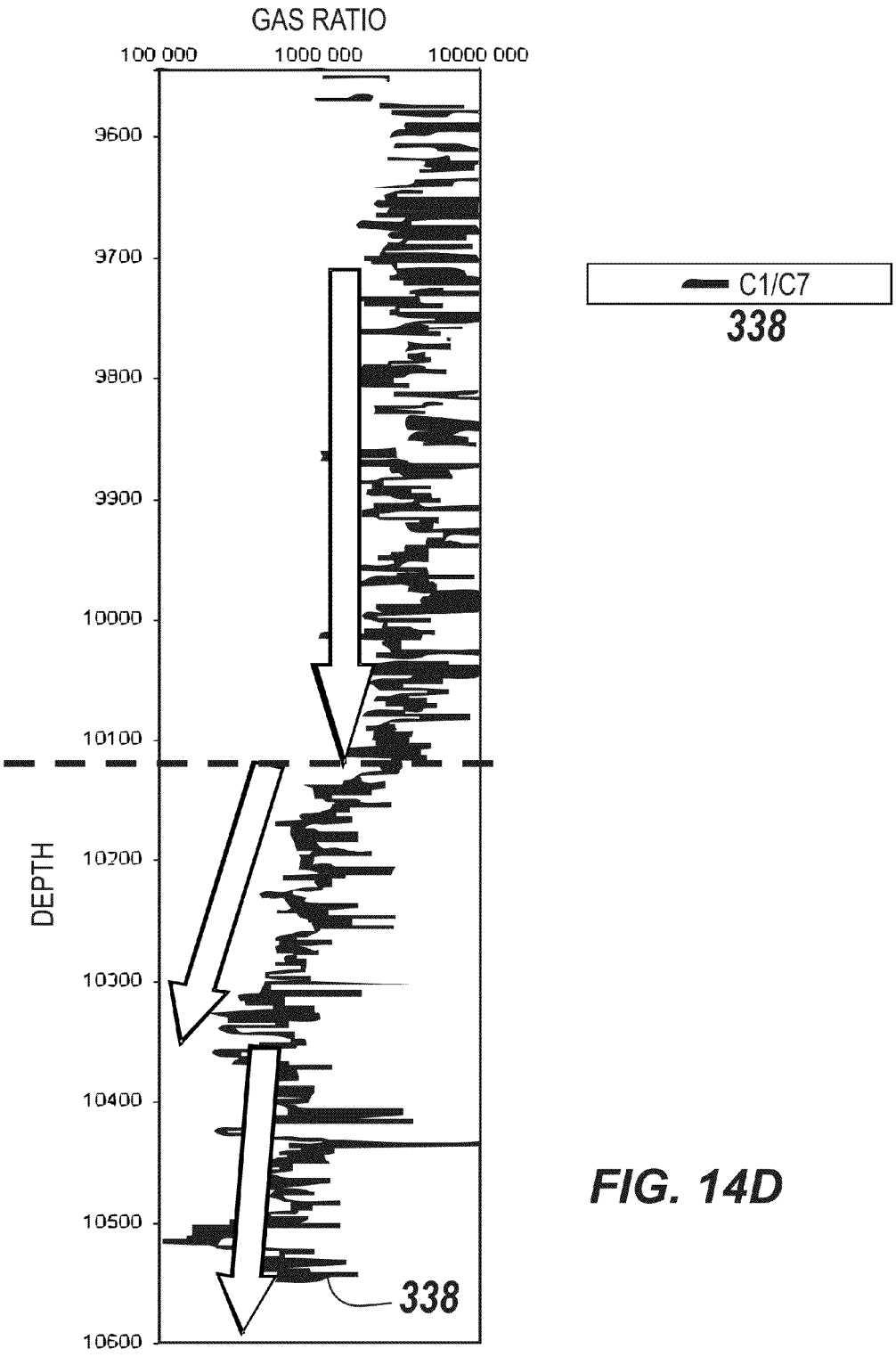

FIGS. 13A-13C show three images of the same formations. The formation's image 320 in FIG. 13A is picked out by gamma ray 321. The formation's image 322 in FIG. 13B is overlain by the gas ratio (C1/Total Hydrocarbons) 323, and the formation's image 324 in FIG. 13C is overlain with the ratio (C1/Total Gas) 325 obtained using the gas evaluation device 150 according to the techniques of the present disclosure.

The trend of the two gas ratios 323/325 in FIGS. 13B and 13C clearly identifies the boundaries of each sandstone reservoir in the formation's images. In particular, the boundaries are identified by the sharp inflections in the ratios 323/325 at the top of each block brought about by faulting yet characterizing the boundaries with good cap seal efficiency. The relatively low values of methane content in the ratio (C1/ΣC) 323 between 0.4 and 0.5 in FIG. 13B indicates the presence of a liquid (oil) rather than a gas phase. The gradual decrease in methane content also highlights gradual decrease in fluid gravity.

2. Oil/Water Contacts

The gas evaluation device 150 can identify reservoir fluids contacts as well as evaluate water saturation during the drilling operation. As shown in FIGS. 14A-14D, analysis of particular gas ratios—(toluene/C7) ratio 330, (benzene/C6) ratio 332, (C1/C4+C5) ratio 334, (benzene+toluene/C1+C8) ratio 336, and (C1/C7) ratio 338 can identify oil/water contacts (OWC) and water saturation in the formation. These particular gas ratios exploit differences in solubility in water of the relative gases. For example, the toluene/C7 ratio 330 and the benzene/C6 ratio 332 shown in FIGS. 14A-14D compare the highly soluble aromatics with their n-alkane counterparts to form part of the information. The C1/C7 ratio 338 helps identify the water contact through the difference in fluid characteristics. Other suitable ratios could be used to locate gas-oil contacts, which would be useful for infill drilling operations.

3. Fluid Variation

Figure 15:
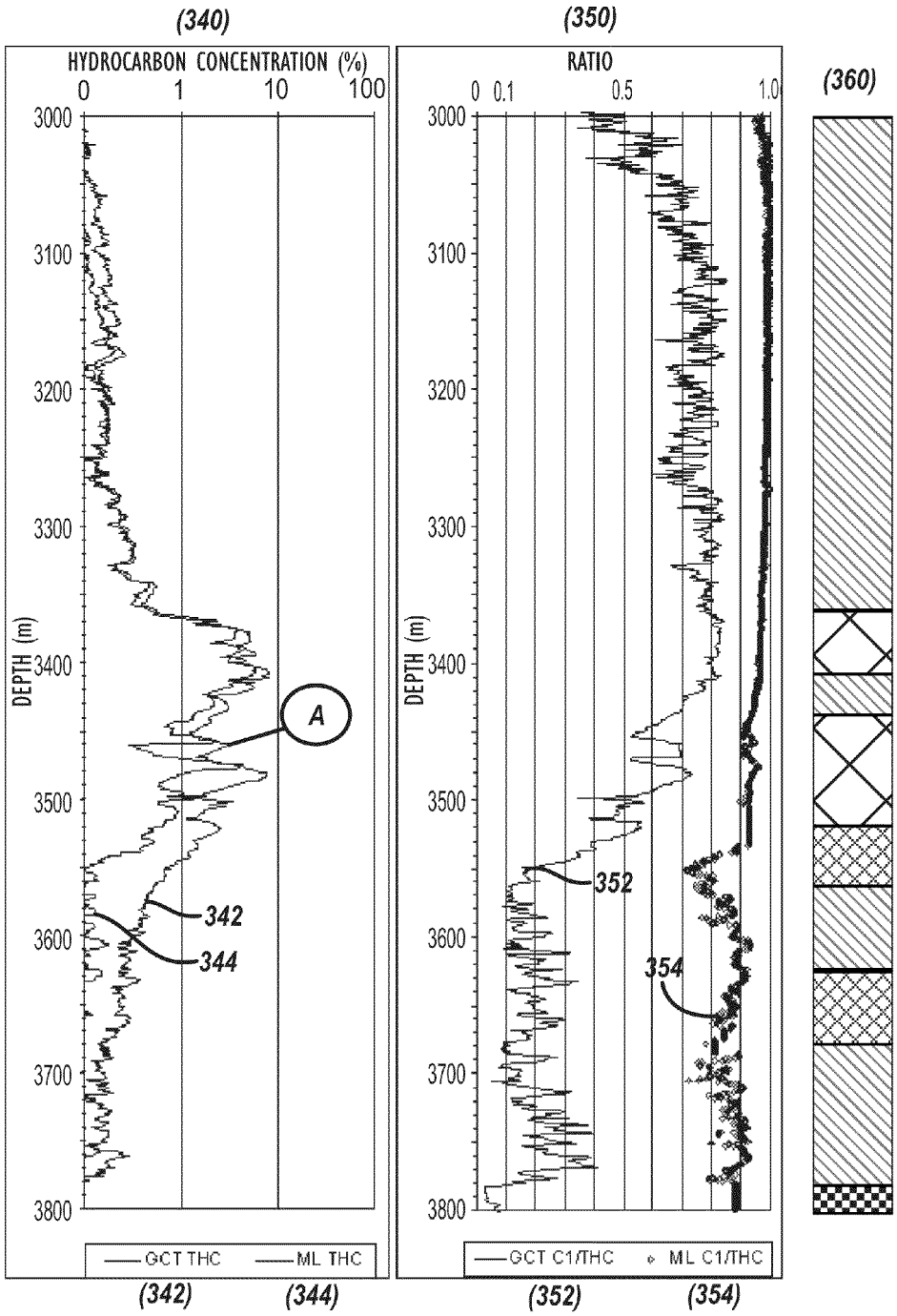
FIG. 15 shows a first graph plotting total hydrocarbon concentration (%) relative to drilling depth, a second graph plotting a gas ratio of C1/total hydrocarbon relative to drilling depth, and a third graph diagrammatically depicting the lithology of a formation with different zones.

FIG. 15 shows a first graph 340 plotting total hydrocarbon concentration (%) relative to drilling depth and shows a second graph 350 plotting a gas ratio of C1/total hydrocarbon relative to drilling depth. A third graph 360 diagrammatically depicts the lithology of a formation with different zones.

In the first graph 340, a first total hydrocarbon concentration signature (342) has been obtained using the membrane-based probe (160) behind the choke manifold (100) as disclosed herein. This is plotted relative to a total hydrocarbon concentration signature (344) obtained using a conventional gas trap after the separator (120). As shown, the total hydrocarbon concentration signatures (342/344) diverge at point (A) as heavier hydrocarbons increase in relevance. Therefore, using the probe (160) as disclosed herein can provide a better understanding of the gas concentrations based on drilling depth during the drilling operation.

In the second graph 350, a first ratio C1/THC (352) has been obtained using the membrane-based probe (160) as disclosed herein. This is plotted relative to a second ratio C1/THC (354) obtained using a conventional gas trap. As shown, the standard gas trap ratio (354) shows a constant methane content. However, the first ratio (352) obtained according to the techniques disclosed herein shows that both the methane and the gas composition content depend on the rock type (indicated by lithology 360) and the fluid phase entrapped.

Figure 16A:
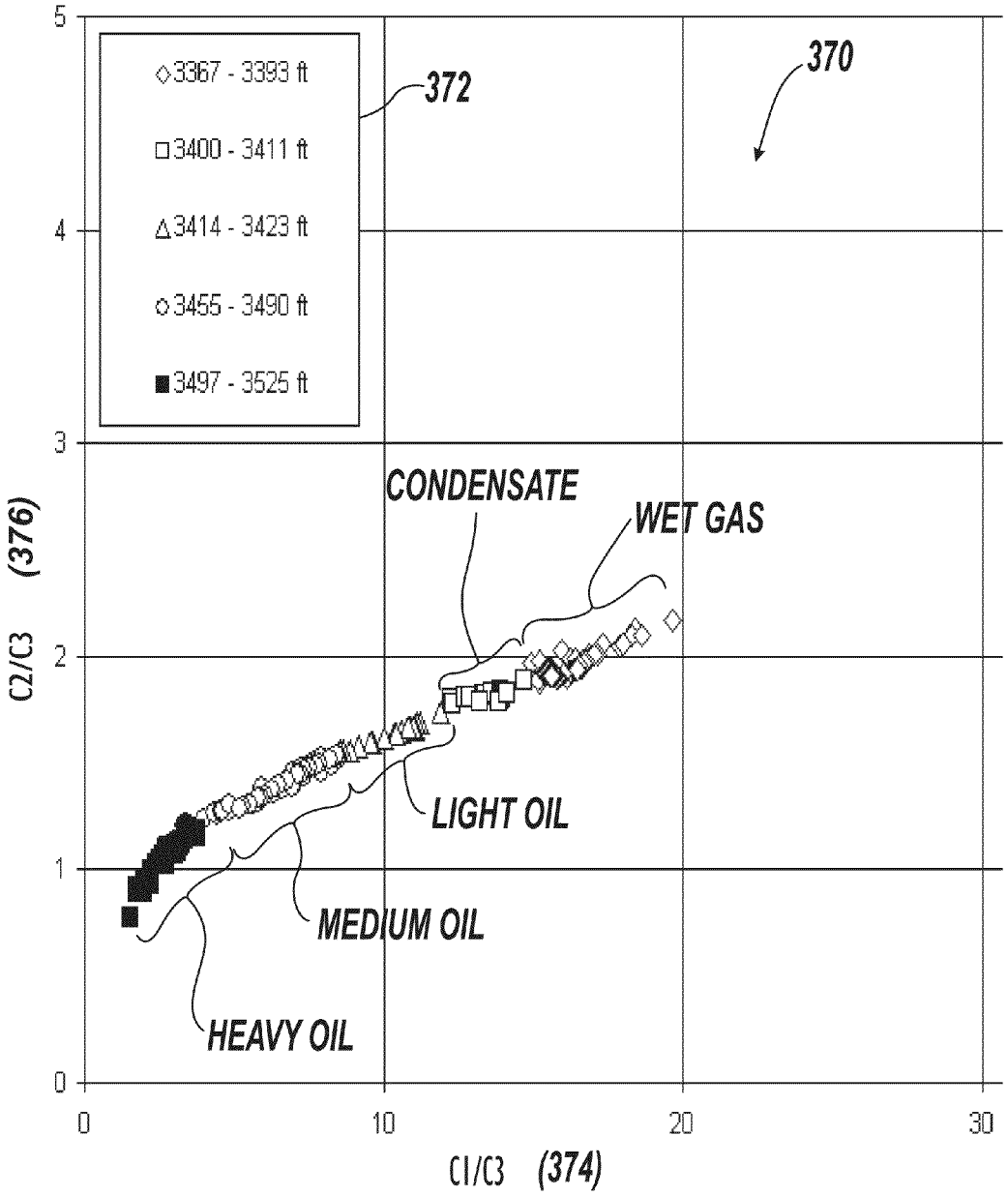
FIGS. 16A-16B show two graphs plotting gas readings relative to drilling depth.
Figure 16B:
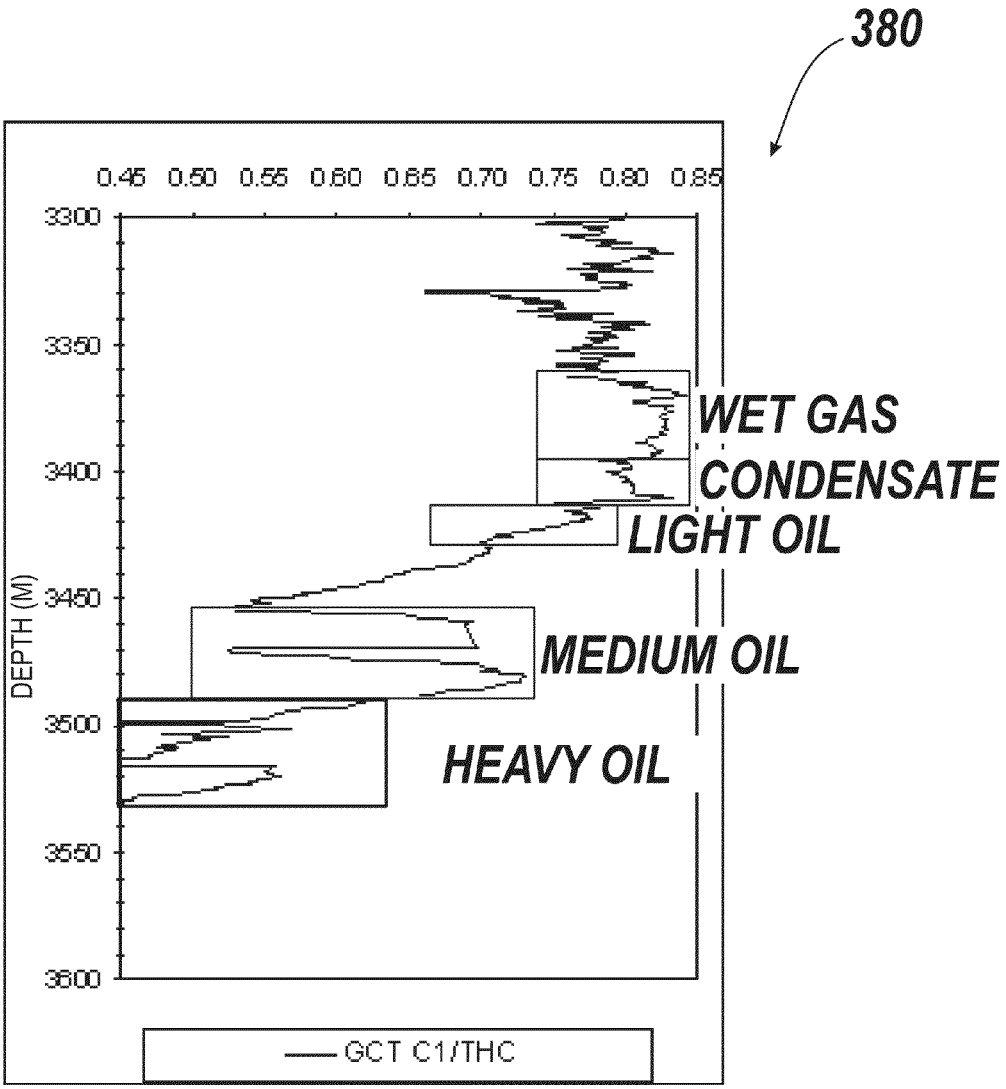

FIGS. 16A-16B show two graphs 370/380 plotting gas readings relative to drilling depth. Here, these gas readings have been obtained using the membrane-based probe (160) according to the techniques disclosed herein. In the first graph 370, points (372) based on different depth readings are plotted as a function of a first ratio (C1/C3) (374) and a second ratio (C2/C3) (376). The values of these ratios help to indicate what points are indicative of heavy oil, medium oil, light oil, condensate, and wet gas. Then, the points and type of fluids can be displayed according to depth intervals (e.g., 3367-3393 ft, 3400-3411 ft, etc.) that contain these particular types of fluids. The second graph 380 depicts a ratio (C1/total hydrocarbon) plotted relative to depth and show the depth intervals for the different types of fluids determined in the first graph (370).

As these graphs 370/380 show, the gas readings obtained according to the techniques disclosed herein can be used to show the various fluid variations relative to drilling depth as the drilling operation is performed. This information can also be combined with the bottomhole pressure at various depths. The bottomhole pressures can be determined during drilling based on the pressure information obtained with the choke manifold (100) of the system (10). Correlated in this manner, the variations in fluid and the downhole pressures associated therewith can give operators a more comprehensive view of the formation being drilled.

4. Locating Sweet Spots in Reservoir

Figure 17A:
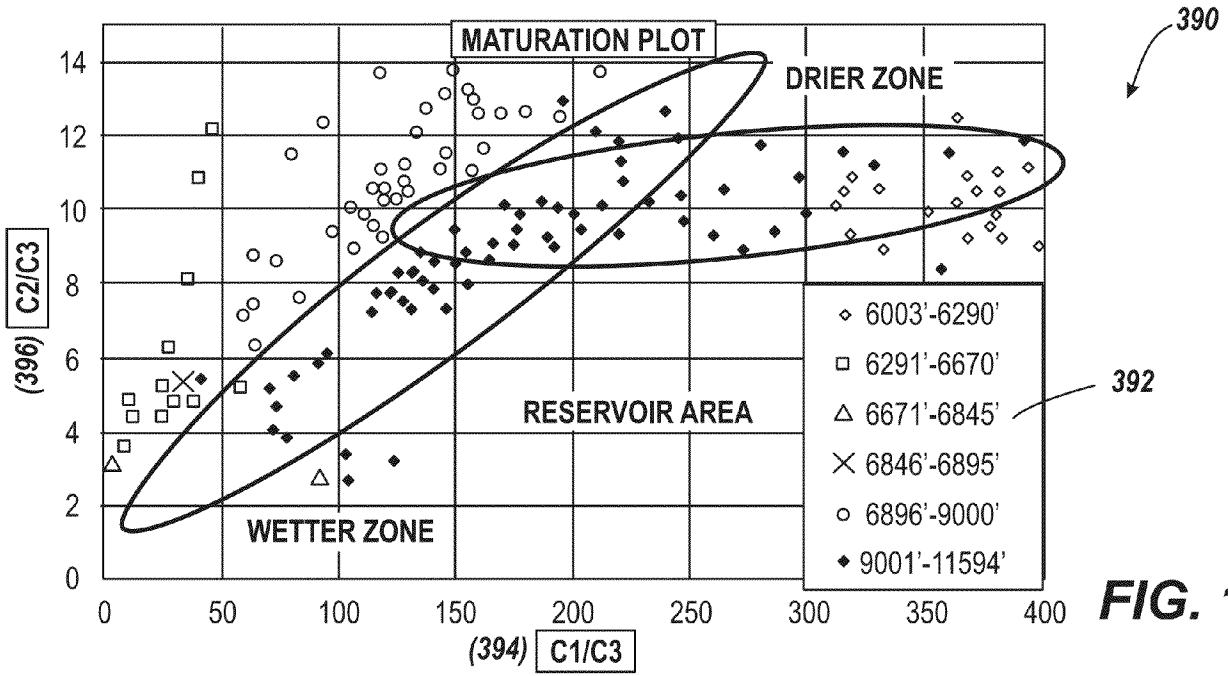
FIG. 17A shows a maturation plot plotting drilling depth points relative to two ratios.

As discussed herein, the membrane-based probe (160) and high speed gas chromatograph (168) obtaining gas readings from the system (10) between the choke manifold (100) and the gas separator (120) can yield improved ratio analysis. As shown in FIG. 17A, these improved ratios can be used to locate sweet spots in a reservoir, such as in shale plays, sandstone, and other formations. A maturation plot 390 in FIG. 17 plots drilling depth points 392 relative to a first ratio (C1/C3) (394) and a second ratio (C2/C3) (396). The plot reveals the reservoir area and its wetter and drier zones.

Figure 17B:
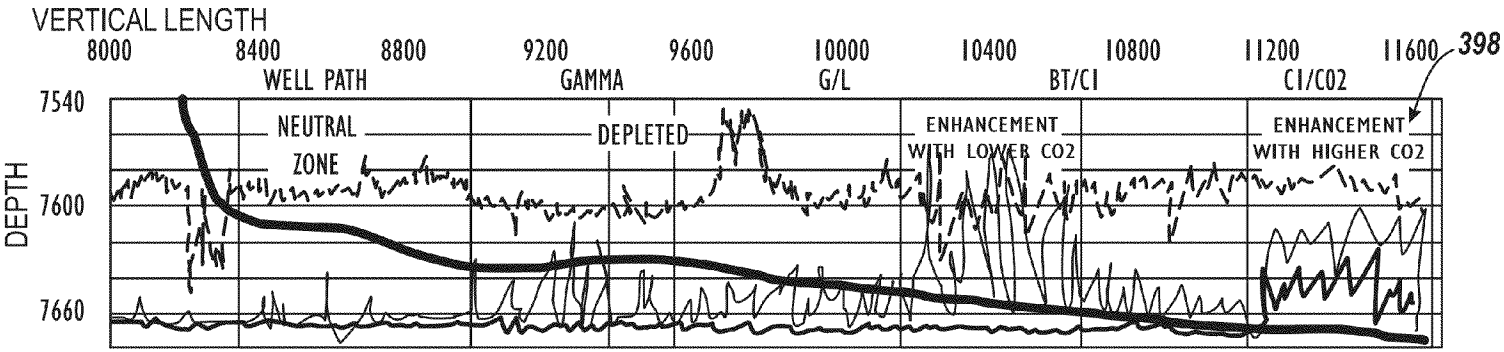
FIG. 17B shows a graph of a well path, gamma reading, gas-to-liquid ratio (G/L), and first and second hydrocarbon ratios.

The graph (398) in FIG. 17B graphs a well path, gamma reading, gas-to-liquid ratio (G/L), first hydrocarbon ratio (benzene+toluene/C1), and a second hydrocarbon ratio (C1/$CO_2$). From this combination of readings in the graph (398), operators can determine various forms of information about different zones in the formation.

5. Formation Permeability and Pressure Characterization

The system 10 can also be used to determine both permeability and pressure distributions of the formation to characterize the reservoir. As disclosed in the context of underbalanced drilling in co-pending U.S. application Ser. No. 12/038,715 entitled "System and Method for Reservoir Characterization Using Underbalanced Drilling Data" (which is incorporated herein by reference in its entirety), variable rate well testing can be used to interpret production associated with the drawdown maintained throughout an underbalanced drilling (UBD) operation. This variable rate well testing can then determine both the permeability and the pressure distributions to characterize the reservoir being drilled in real-time during the underbalanced drilling operation. Using a two-rate test, the techniques identify both the permeability and pressure distributions by achieving enough rate variation to determine the distributions sufficiently. Accordingly, it is possible to identify a permeability distribution in which high permeability layers or other similar objects like fractures can be detected.

In this process, a change is induced in the flowing bottom hole pressure in the wellbore using the drilling system by creating a pressure disturbance when stopping circulation of the drilling system to connect a stand. The surface flow rate data of effluent is measured by the multi-phase flow meter (130; FIG. 1B) in response to the induced change. As noted previously, the multi-phase flow meter (130; FIG. 1B) is disposed upstream from the gas separator (120) of the drilling system (10). The variations in the measured surface flow rate data are translated through modeling and calculations to downhole conditions by correcting for wellbore capacity effects. The data acquisition system 170 then analyzes the flowing bottomhole pressure and the measured surface flow rate data and determines both permeability and formation pressure for a portion of the wellbore to characterize the portion of the wellbore. The permeability and the pressure distributions determined by such techniques can then be combined with the gas readings for the formation obtained by the gas evaluation device 150 and techniques disclosed herein to further characterize the formation.

6. Additional Determinations

The gas evaluation device 150 provides a reliable means of hydrocarbon analysis that can significantly improve identification of reservoir features and can clarify portions of the reservoir. Consistent with the teachings disclosed herein, the system 10 can be used during MPD, UBD or other controlled pressure drilling operations to identify lithological changes, formation tops, reservoir delimitation (net pay zone), different hydrocarbon fluid phases, fluids contact, lithological and structural barriers. In addition, the system 10 can estimate fluid density, rock permeability, biodegradation, maturity grade, fractioning grade, gas leakage, and thermal unit (BTU) from the information obtained during the MPD or UBD operation.

Finally, because the drilling system 10 and gas evaluation device 150 can together provide comprehensive information of the formation as it is being drilled, it follows that this information can be used to actually direct the drilling profile when a geosteering or directional drilling system is used. For example, when a horizontal well is being drilled, monitoring of the gas readings with the gas evaluation device 150 can indicate to the directional drilling operators that the drilling has left a particular zone of interest due to a change in the gas readings encountered. In turn, the directional drilling operators can use the continual readings and direct or steer the drilling to the desired zone.

G. Accurate Readings Reducing Drilling Time

The gas readings obtained with the gas evaluation device 150 in the system 10 can be used in conjunction with Corilos flow and density measurements from the other components of the system 10 to reduce drilling time and costs. For example, the combined information can provide evidence of when a gas influx has occurred, and the information can then be used to indicate that the influx has been circulated out so that drilling can proceed. The potential time savings are significant and can reduce rig operation costs on any given well.

Figure 18A:
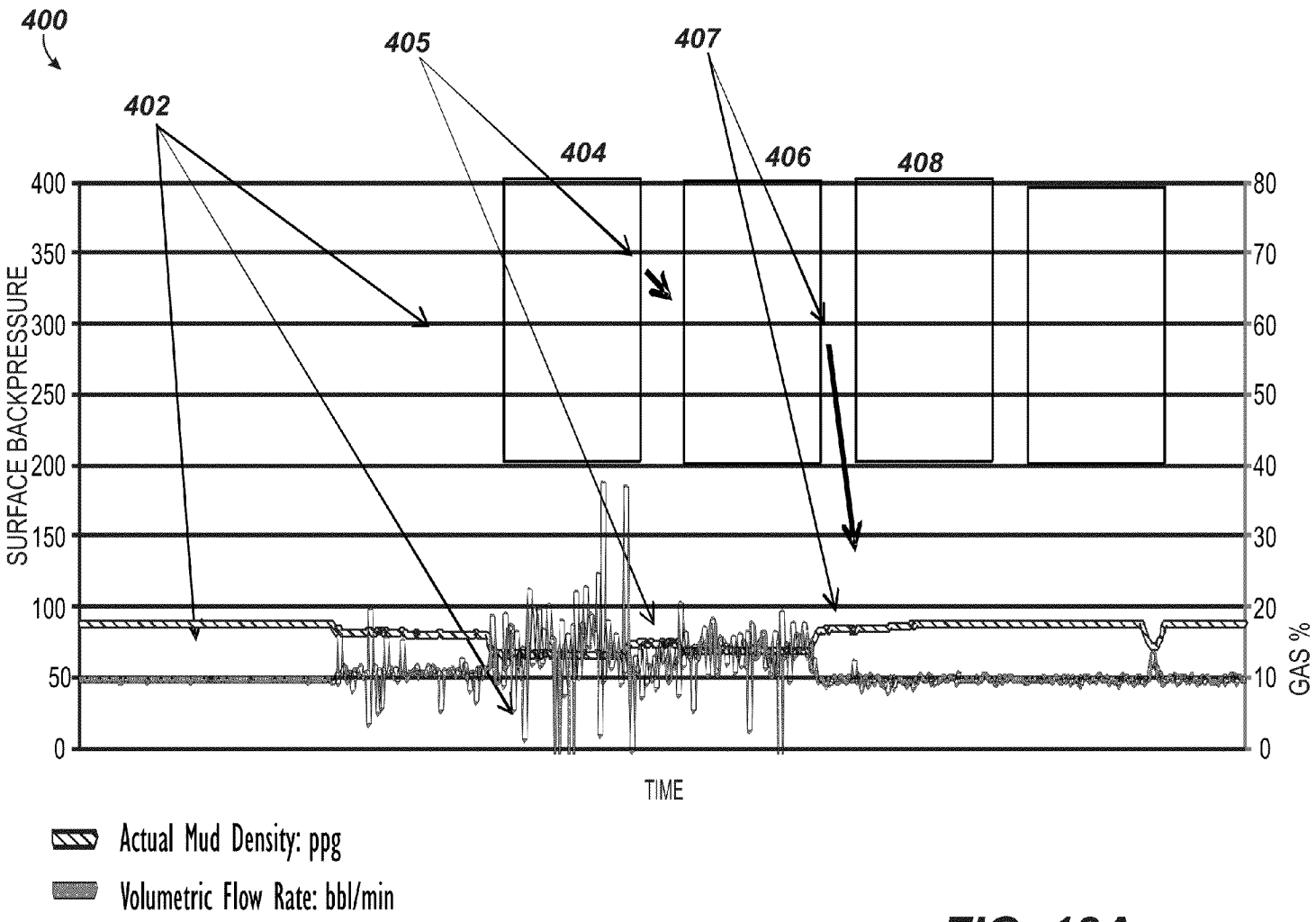
FIGS. 18A-18B show responses of the gas evaluation device for a kick occurring in a managed pressure drilling operation.
Figure 18B:
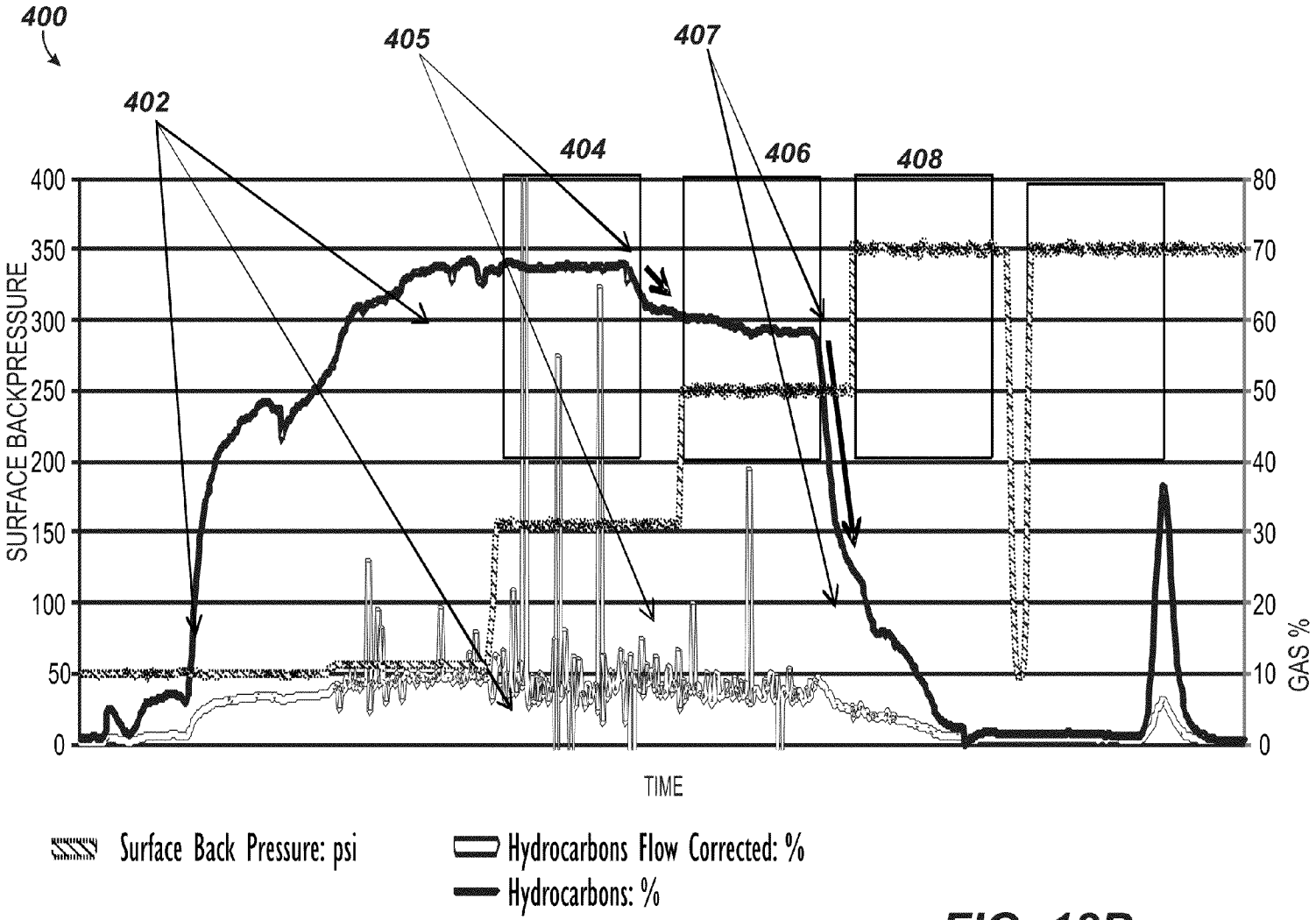

The graph 400 in FIGS. 18A-18B show gas response of the disclosed gas evaluation device (150) relative to one kick event during a drilling operation. As described below, the accurate measurements from the gas evaluation device (150) can help operators detect when a kick has been successfully killed so that drilling can be promptly resumed. This graph 400 shows only one example of one kick occurring during drilling. In a given operation, several such events may occur that require operators to respond. Being able to more accurately determine when the influx has been killed can thereby greatly reduce the drilling time involved in handling such influxes so productive drilling can continue.

As shown in the managed pressure during operation, a gas increase of 24% (Total Hydrocarbon) was observed with the disclosed gas evaluation device (150) at 402. The mud density decreased from 17.66 ppg to 16.30 ppg. Operators picked the bit off bottom and reduced the RPM to 20. Operators then circulated bottoms up twice to confirm a gas influx had occurred. Gas detected continued to increase to 53% at the first bottoms up circulation and then increased to 70% at the end of the second bottoms up circulation. Gas cut mud was 13.22 ppg.

At one stage 404, the system 10 applied surface backpressure (SBP) of 155 psi with the system's choke manifold (100) and circulated bottom's up. The gas detected decreased to 63% as shown at 405 after the bottom's up time, and the mud density increased to 14.80 ppg.

At a second stage 406, the system 10 increased the surface backpressure (SBP) to 250 psi with the choke manifold (100) and circulated bottoms up again. At 407, the gas detected rapidly decreased, and the mud density increased to 16.70 ppg. Continuing with the circulation, the corrected gas readings from the gas evaluation device (150) decreased to 4% following the second bottoms up circulation.

At a third stage 408, the system 10 increased the surface backpressure to 350 psi with the choke manifold 100. The gas reading recorded from the gas evaluation device (150) at the bottoms up was 2.5%, and there was no significant increase in the density after applying the 350 psi surface backpressure. Essentially, the well was effectively killed at the surface backpressure of 250 psi at stage 406. Therefore, the third stage 408 of increasing the surface backpressure to 350 psi was probably not necessary. By utilizing the gas data from the gas evaluation device (150) and noticing the gas decline at the second stage 406, the system 10 and operators could have recognized that any additional stage of increased surface backpressure may not be necessary because the well has been effectively killed. By then avoiding any third attempt to increase surface backpressure, the system and operators could have resumed drilling much sooner and saved several hours of rig time in the process.

Figure 19:
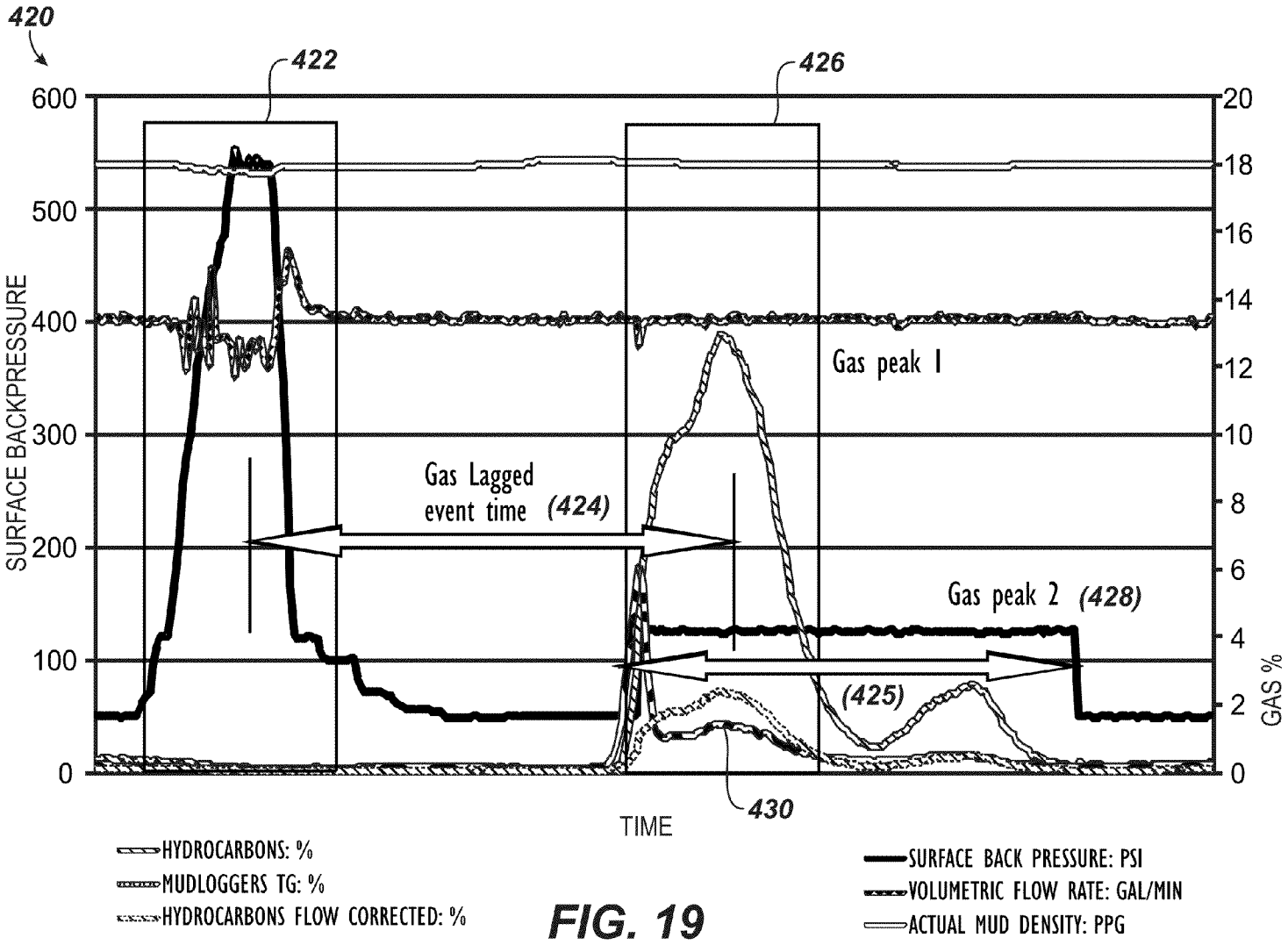
FIG. 19 shows responses of the gas evaluation device for gas peaks occurring after a dynamic formation integrity test.

Along the same lines, a graph 420 in FIG. 19 shows gas readings from the gas evaluation device (150) during a dynamic formation integrity test (FIT). In this test, the system 10 pressures up the well to an elevated level but not enough to break the formation. For example, at stage 422, the system 10 applied surface pressure of 550 psi at using managed pressure drilling to achieve a 10-minute test where pressure remains constant. Following a lag cycle 424 after the FIT stage 422, the gas evaluation device (150) obtained a corrected gas response of 4.33% in stage 426. In response to the gas influx, a surface backpressure of 125 psi was applied by choke manifold (100) at stage 426 to control the gas event.

The first gas response was followed by a second gas response at 428 due to the reduced mud hydrostatic head in the mud column on the surface. This induced a secondary leakage of gas into the well with a corrected gas peak of 0.85% at 428. The system 10, however, continued applying the surface backpressure for interval 425 until the gas had been removed from the system.

The gas response of the gas evaluation device (150) shows that the formation took drilling fluid during the dynamic formation integrity test and released the fluid back at the peak in stage 426 to the hole once the surface backpressure from the manifold 110 was removed. Formation gas was also released into the wellbore. The system continued to apply surface backpressure to control the gas influx from the FIT even up to the back flow event at peak 428.

Response 430 of conventional mud logging gas detection after the gas separator is also shown in the graph 420. After the initial gas response at stage 426, the mud logging gas detection cannot be used to monitor gas levels on the rig site as the flow line had been bypassed. The gas evaluation device (150), however, can continue to give information about gas levels within the system 10 even when the well was being controlled. The gas evaluation device (150) can also give further information about the secondary induced gas kick at peak 428 due to the reduced hydrostatic column once the initial gas influx passed up the wellbore. In the end, the gas response of the disclosed gas evaluation device (150) can give an early indication as to the safe removal of the gasses from the system so that the surface backpressure from the choke manifold (110) can be removed from the system soon after the event had finished. As can be seen, the gas response from the gas evaluation device (150) can then allow operators to return to normal drilling operations and reduce rig time and costs, while sufficiently handling an influx at the same time.

Figure 20A:
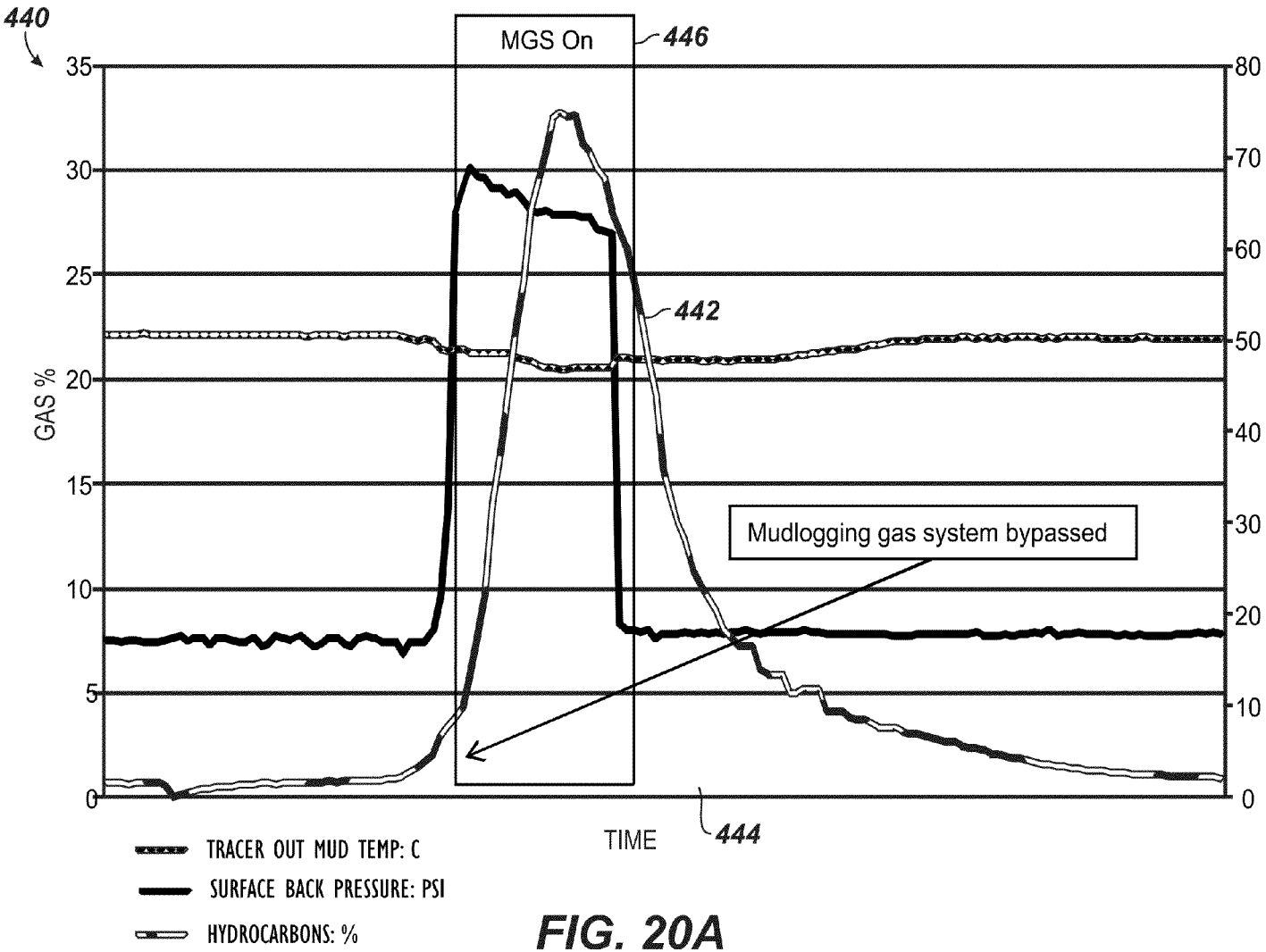
FIGS. 20A-20B compare responses of the gas evaluation device and conventional mud logging detectors after pump stoppage in the managed pressure drilling operation.
Figure 20B:
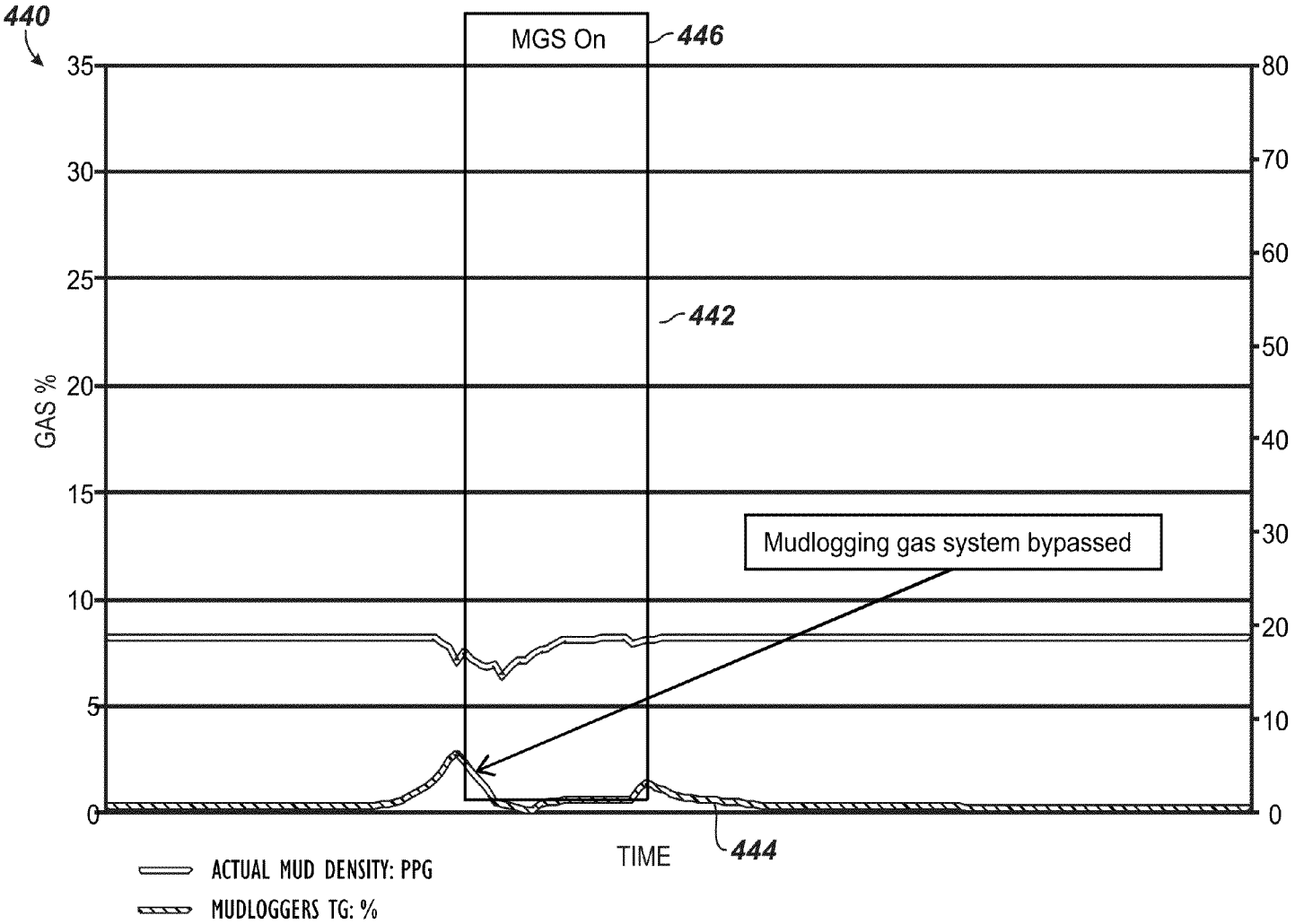

Further confirming the useful gas readings of the gas evaluation device (150), a graph 440 in FIGS. 20A-20B show gas readings 442 from the gas evaluation device (150) compared to readings 444 using conventional gas trap methods. Initially, the pumps are switched off at a point in time before the graph 440. Then, a gas peak at stage 446 results from the earlier Pump Off situation. This gas response is due to the reduced hydrostatic pressure and eventually produces an uncorrected gas reading of 32.79% at stage 446 with the gas evaluation device (150).

As the gas peak reached surface and the mud logging detector readings 444 reached 5%, the flow was diverted via the degasser of the mud gas separator 120. Therefore, the conventional mud logging gas detector for most of the event was unable to monitor the gas peak due to the diverted mudflow away from its sensor location.

Unlike conventional mud logging gas systems, the gas evaluation device (150) can provide constant gas readings throughout the above event. This can allow the drilling operators to monitor the surface gas values within the system 10 and to decide earlier about the safe control of the gas influx event.

The foregoing description of preferred and other embodiments is not intended to limit or restrict the scope or applicability of the inventive concepts conceived of by the Applicants. For example, although the gas evaluation device 150 has been disclosed herein as using the gas chromatograph 168, it will be appreciated that the gas can be detected in a number of ways, including gas chromatography (GC), thermal catalytic combustion (TCC), hot wire detector (HWD), thermal conductivity detector (TCD), flame ionization detector (FID), infrared analyzer (IRA), and Mass/Ion selective devices (MS, IRMS, GCMS). In addition, it is understood that the gas evaluation device 150 can be combined with other mud logging equipment and that the gas readings obtained can be incorporated into analysis of rate of penetration (ROP), pump rate, examination of drill cuttings, weight on bit, mud weight, mud viscosity, and other drilling parameters that can be complied in real-time.

What is claimed is:

1. A controlled pressure drilling system, comprising:

a choke in fluid communication with a wellbore and controlling flow of drilling fluid from the wellbore;

an evaluation device in fluid communication with the flow of drilling fluid between the wellbore and a gas separator, the evaluation device evaluating fluid content in the drilling fluid flowing from the wellbore; and a controller operatively coupled to the choke and the evaluation device, the controller monitoring one or more parameters indicative of at least a fluid influx in the wellbore, the controller determining passage of the drilling fluid associated with the fluid influx from the wellbore past the evaluation device and determining the fluid content associated with the fluid influx, the controller correlating the determined fluid content to density of the drilling fluid and determining a volume of the fluid content associated with the fluid influx.

2. The system of claim 1, wherein the evaluation device is in fluid communication with the flow of drilling fluid between the choke and the gas separator.

3. The system of claim 1, wherein the choke is in fluid communication with a rotating control device of the wellbore.

4. The system of claim 1, wherein the evaluation device comprises a probe disposed in the flow of drilling fluid from the wellbore and extracting a fluid sample therefrom.

5. The system of claim 4, wherein the probe comprises a permeable membrane separating a carrier fluid from the drilling fluid and permitting passage of the fluid sample therethrough.

6. The system of claim 5, wherein the evaluation device comprises a purge circuit in fluid communication with the probe and pneumatically purging the probe of fluid.

7. The system of claim 5, wherein the evaluation device comprises a gas chromatograph obtaining the extracted fluid sample entrained in the carrier fluid from the probe and evaluating the fluid content of the extracted fluid sample.

8. The system of claim 1, further comprising:

a flow meter in fluid communication with the flow of drilling fluid from the wellbore, wherein the controller is operatively coupled to the flow meter and determines the density of the drilling fluid based at least in part on measurements from the flow meter.

9. The system of claim 1, wherein the controller correlates the determined volume for the fluid content to a bottomhole pressure in a portion of the wellbore where the fluid influx occurred and characterizes the portion of the wellbore based on the correlation.

10. The system of claim 1, wherein the controller evaluates initial fluid content of flow of drilling fluid into the wellbore and subtracts the initial fluid content from the fluid content evaluated from the flow of drilling fluid out of the wellbore.

11. The system of claim 10, wherein the evaluation device comprises an ancillary probe disposed in the flow of the drilling fluid into the wellbore.

12. The system of claim 1, wherein the controller adjusts the choke in response to the one or more monitored parameters and controls surface backpressure in the wellbore thereby.

13. The system of claim 1, wherein the controller monitors one or more parameters indicative of a fluid loss in the wellbore and adjusts the choke in response to the one or more monitored parameters.

14. The system of claim 1, wherein the evaluation device receives a sample of the drilling fluid routed or purged thereto.

15. The system of claim 14, wherein the evaluation device comprises a gas chromatograph, an optical sensor, a mass spectrometer, or a mud logging sensor analyzing the sample of the drilling fluid received.

16. The system of claim 1, wherein the evaluation device comprises:

a first flow line disposed in fluid communication with the flow of drilling fluid between the wellbore and the gas separator, the first flow line being separately isolatable from the flow of drilling fluid; and a second flow line having a closure for bypassing the first flow line.

17. A controlled pressure drilling system, comprising:

an evaluation device in fluid communication with flow of drilling fluid from a wellbore, the evaluation device evaluating fluid content in the drilling fluid from the wellbore upstream of a gas separator; and a controller operatively coupled to the evaluation device, the controller monitoring one or more parameters indicative of at least a fluid influx in the wellbore, the controller determining passage of the drilling fluid associated with the fluid influx from the wellbore past the evaluation device and determining the fluid content associated with the fluid influx, the controller correlating the determined fluid content to density of the drilling fluid and determining a volume of the fluid content associated with the fluid influx.

18. The system of claim 17, further comprising a choke in fluid communication with the wellbore and controlling the flow of drilling fluid from the wellbore.

19. The system of claim 18, wherein the controller is operatively coupled to the choke and adjusts the choke in response to the one or more monitored parameters.

20. The system of claim 17, further comprising:

a flow meter in fluid communication with the flow of drilling fluid from the wellbore, wherein the controller is operatively coupled to the flow meter and determines the density of the drilling fluid based at least in part on measurements from the flow meter.

21. The system of claim 17, wherein the controller correlates the determined volume for the fluid content to a bottomhole pressure in a portion of the wellbore where the fluid influx occurred and characterizes the portion of the wellbore based on the correlation.

22. The system of claim 17, wherein the controller evaluates initial fluid content of flow of drilling fluid into the wellbore and subtracts the initial fluid content from the fluid content evaluated from the flow of drilling fluid out of the wellbore.

23. The system of claim 17, wherein the evaluation device comprises a gas chromatograph, an optical sensor, a mass spectrometer, or a mud logging sensor analyzing the sample of the drilling fluid received.

24. A controlled pressure drilling method, comprising:

controlling surface backpressure in a wellbore by controlling flow of drilling fluid from the wellbore;

monitoring one or more parameters indicative of at least a fluid influx in the wellbore;

determining passage of the drilling fluid associated with the fluid influx from the wellbore past a point downstream from the wellbore and upstream from a gas separator;

evaluating fluid content in the drilling fluid associated with the fluid influx passing the point from the wellbore; and determining a volume of the fluid content associated the fluid influx by correlating the evaluated fluid content to density of the drilling fluid associated with the fluid influx.

25. The method of claim 24, wherein monitoring the one or more parameters indicative of at least the fluid influx in the wellbore further comprises adjusting surface backpressure in the wellbore in response to the one or more monitored parameters.

26. The method of claim 24, wherein evaluating fluid content comprises extracting a fluid sample from the drilling fluid disposed in a flow line downstream from the wellhead.

27. The method of claim 26, wherein extracting the fluid sample comprises entraining the fluid sample in a carrier fluid.

28. The method of claim 27, wherein evaluating the fluid content comprise performing gas chromatography on the extracted fluid sample entrained in the carrier fluid.

29. The method of claim 24, comprising measuring flow of the drilling fluid from the wellbore and determining the density of the drilling fluid associated with the fluid influx based at least in part on the measured flow.

30. The method of claim 24, further comprising characterizing a portion of the wellbore associated with the fluid influx by correlating the determined volume for the fluid content to a bottomhole pressure in the portion of the wellbore associated with the fluid influx occurred.

31. The method of claim 24, further comprising evaluating initial fluid content in the flow of the drilling fluid into the wellbore and subtracting the initial fluid content from the evaluated fluid content from the flow of drilling fluid out of the wellbore.

32. The method of claim 24, further comprising monitoring one or more parameters indicative of a fluid loss in the wellbore and adjusting backpressure in the wellbore in response to the one or more monitored parameters.

33. A controlled pressure drilling system, comprising:

an evaluation device in fluid communication with flow of drilling fluid between a wellbore and a gas separator, the evaluation device evaluating fluid content in the drilling fluid flowing from the wellbore, the evaluation device comprising:

a probe disposed in the flow of drilling fluid from the wellbore and extracting a fluid sample therefrom, the probe comprising a permeable membrane separating a carrier fluid from the drilling fluid and permitting passage of the fluid sample therethrough, and a purge circuit in fluid communication with the probe and pneumatically purging the probe of fluid at least including the fluid sample and the carrier fluid; and a controller operatively coupled to the evaluation device, the controller monitoring one or more parameters indicative of at least a fluid influx in the wellbore, the controller determining passage of the drilling fluid associated with the fluid influx from the wellbore past the evaluation device and determining the fluid content associated with the fluid influx.

34. The system of claim 33, further comprising a choke in fluid communication with the wellbore and controlling the flow of drilling fluid from the wellbore, wherein the controller is operatively coupled to the choke and adjusts the choke in response to the one or more monitored parameters, and wherein the evaluation device is in fluid communication with the flow of drilling fluid between the choke and the gas separator.

35. The system of claim 33, wherein the evaluation device comprises a gas chromatograph obtaining the extracted fluid sample entrained in the carrier fluid from the probe and evaluating the fluid content of the extracted fluid sample.

36. The system of claim 33, wherein the controller correlates the determined fluid content to density of the drilling fluid and determines a volume of the fluid content associated the fluid influx.

37. The system of claim 36, further comprising:

a flow meter in fluid communication with the flow of drilling fluid from the wellbore, wherein the controller is operatively coupled to the flow meter and determines the density of the drilling fluid based at least in part on measurements from the flow meter.

38. The system of claim 36, wherein the controller correlates the determined volume for the fluid content to a bottomhole pressure in a portion of the wellbore where the fluid influx occurred and characterizes the portion of the wellbore based on the correlation.

39. The system of claim 33, wherein the controller evaluates initial fluid content of flow of drilling fluid into the wellbore and subtracts the initial fluid content from the fluid content evaluated from the flow of drilling fluid out of the wellbore.

* * * * *